US012643582B2

(12) United States Patent
Kinghorn

(10) Patent No.: US 12,643,582 B2
(45) Date of Patent: Jun. 2, 2026

(54) EXTENDABLE COUPLER

(71) Applicant: John Kinghorn, Hants (GB)

(72) Inventor: John Kinghorn, Hants (GB)

( * ) Notice: Subject to any disclaimer, the term of this patent is extended or adjusted under 35 U.S.C. 154(b) by 531 days.

(21) Appl. No.: 18/033,502

(22) PCT Filed: Oct. 27, 2021

(86) PCT No.: PCT/GB2021/052792
§ 371 (c)(1),
(2) Date: Apr. 24, 2023

(87) PCT Pub. No.: WO2022/090715
PCT Pub. Date: May 5, 2022

(65) Prior Publication Data

US 2023/0406371 A1 Dec. 21, 2023

(30) Foreign Application Priority Data

Oct. 27, 2020 (GB) ..... 2016999

(51) Int. Cl.
*B61G 7/08* (2006.01)
*B61G 3/10* (2006.01)
(Continued)

(52) U.S. Cl.
CPC ..... *B61G 7/08* (2013.01); *B61G 3/10* (2013.01); *B61G 3/16* (2013.01); *B61G 3/20* (2013.01);
(Continued)

(58) Field of Classification Search
CPC ... B61G 7/08; B61G 3/16; B61G 3/20; B61G 7/10; B61G 7/12; B61G 5/02; B61G 5/06; B61G 11/02; B61G 11/04; B61G 1/22
See application file for complete search history.

(56) References Cited

U.S. PATENT DOCUMENTS 3,899,084 A 8/1975 Gobrecht et al.
4,776,474 A 10/1988 Terlecky et al.
(Continued)

FOREIGN PATENT DOCUMENTS

CN 201419713 Y 3/2010
DE 197 57 621 A1 7/1999
(Continued)

OTHER PUBLICATIONS

Combined Search and Examination Report for United Kingdom Patent Application No. GB2016999.1 mailed Mar. 19, 2021, 6 pages.
(Continued)

*Primary Examiner* — Zachary L Kuhfuss
(74) *Attorney, Agent, or Firm* — Cozen O'Connor

(57) ABSTRACT

A coupler for coupling rail vehicles together comprising: an extendable coupling body; an extending mechanism; and a support housing for mounting the coupler to a railway carriage, wherein the coupling body and the extending mechanism are mounted within the support housing, the extending mechanism being arranged to move the coupling body relative to the support housing between a retracted position and an extended position; wherein the coupling body comprises a coupling interface that is arranged to receive connections of the railway carriage for coupling to a coupling interface of a second coupler; wherein a distance between the coupling interface and the support body increases as the coupling body moves from the retracted position towards the extended position; and wherein the coupling interface is arranged to engage the coupling interface of the second coupler upon contact between the interfaces.

20 Claims, 10 Drawing Sheets

(51) Int. Cl.

| | |
|---|---|
| ***B61G 3/16*** | (2006.01) |
| ***B61G 3/20*** | (2006.01) |
| ***B61G 5/02*** | (2006.01) |
| ***B61G 5/06*** | (2006.01) |
| ***B61G 7/10*** | (2006.01) |
| ***B61G 7/12*** | (2006.01) |

(52) U.S. Cl.
CPC ..... *B61G 5/02* (2013.01); *B61G 5/06* (2013.01); *B61G 7/10* (2013.01); *B61G 7/12* (2013.01)

(56) References Cited

U.S. PATENT DOCUMENTS

| | | | | |
|---|---|---|---|---|
| 12,351,216 | B2 * | 7/2025 | Mandler ..... | B61G 5/00 |
| 2016/0214629 | A1 | 7/2016 | Drexler et al. | |

FOREIGN PATENT DOCUMENTS

| | | | |
|---|---|---|---|
| EP | 0 243 758 | A2 | 11/1987 |
| EP | 0 318 733 | A1 | 6/1989 |
| EP | 1 149 751 | A1 | 10/2001 |

OTHER PUBLICATIONS

International Search Report and Written Opinion of the International Searching Authority for International Patent Application No. PCT/GB2021/052792 mailed Mar. 7, 2022, 12 pages.
International Preliminary Report on Patentability for International Patent Application No. PCT/GB2021/052792 mailed Feb. 16, 2023, 8 pages.

* cited by examiner (a)

(b)

(a)

(b)

(a)

(b)

(a)

(b)

(a)

(b)

EXTENDABLE COUPLER

CROSS-REFERENCE TO RELATED APPLICATIONS

This application is a U.S. National filing of application of International (PCT) Patent Application No. PCT/GB2021/052792 filed Oct. 27, 2021, and titled "Extendable Coupler," the entirety of which is incorporated by reference.

This invention relates to an extendable coupler. In particular, this invention relates to an extendable coupler that is mounted to a railway carriage and coupled to the connections of the railway carriage. The coupler is arranged to be extended, engage and couple with another said coupler to couple the connections of both railway carriages together.

BACKGROUND OF THE INVENTION

There have been several different designs of so-called automatic couplers for rail vehicles since their first introduction over a century ago, but they all depend on the same basic principle. Vehicles requiring to be coupled are physically shunted together, the contact between the coupling heads causing them to hook together or to activate components moving in some way to join the vehicles securely. Uncoupling is achieved by some manually, or automatically, controlled function, the vehicles having to be pulled apart physically to confirm that the separation has occurred successfully.

These approaches of physically shunting vehicles together, although an improvement on earlier manually operated coupling techniques, still have significant problems. When coupling vehicles together, the shunting process must be carried out at low speeds to mitigate any induced stress and/or structural damage between the shunting couplers and/or the rail vehicles the couplers are mounted to. However, the traction control systems of many types of rail vehicles are not well suited to regulating low speeds that would be ideal for the shunting process. Instead, reliance is often placed on the rail vehicle first coming to a stop near the other rail vehicle before, depending on the rail vehicle's considerable inertia, moving again towards one another to initiate the physical shunting process. In this way, the achievable speeds of the rail vehicles are somewhat limited for the shunting process. This is an inefficient process, as time and energy are wasted due to the rail vehicles having to overcome considerable starting inertias after stopping nearby to one another for the shunting process.

A typical operating procedure for a passenger multiple unit rail vehicle intending to couple to another requires a complex and time-consuming sequence of events. Firstly, the driver of the approaching rail vehicle is required to bring it to a stop around 2 metres apart from the other rail vehicle. The rail vehicle then accelerates forward, coming to a stop again about half a metre apart from the other rail vehicle. Finally, the rail vehicle moves forward to complete the coupling action. This process requires considerable skill on the part of the driver to apply and disable power (for moving the rail vehicle) at precisely the appropriate moment—it is easy for drivers to misjudge this moment. If the final drive forward is carried out over enthusiastically, the resulting heavy jolt between the couplers risks shaking standing passengers on the rail vehicles off their feet, spilling drinks or damaging fragile items etc. On the other hand, if the final drive is not vigorous enough, the couplers may not join properly and the rail vehicles must fully uncouple, reverse back, stop, and repeat the process all over again, which is undesirable.

While the above actions are in progress, doors of the rail vehicle must remain locked, and passengers have a frustrating wait to alight, even if they appear to be stopped at the correct platform. Announcements are typically made on the rail vehicle, for example urging passengers to remain seated until the attachment between the rail vehicles has been completed—such instructions are often ignored. Similar issues are also evident when coupling freight vehicles to avoid damage to the goods in transit. In a marshalling yard, a shunting locomotive is often remotely controlled by a member of staff on the ground in a good position to observe the intended coupling. However, considerable skill is still required to manipulate the controls correctly for safe and timely operation to couple the freight vehicles together.

Current methods for uncoupling rail vehicles are also problematic. It is necessary to move sections of rail vehicles a sufficient distance apart when separating them to confirm that separation has been completed successfully. Loading and unloading of the rail vehicles cannot take place during the uncoupling process. This process can cause alarm to passengers unfamiliar with the procedure, thinking they have missed their train, as the doors of the rail vehicles are locked, but not realising that the doors will be unlocked again when the rear section of the rail vehicle has been uncoupled and reversed a short distance away from the front section and comes to a stop. Although announcements are often made at the station to explain what is happening, this is not easy to understand for those unfamiliar with railway operating methods, especially as such techniques are not common.

Similar problems occur when uncoupling freight vehicles with automatic couplers. If it is decided that some wagons in a coupled formation are not needed for a particular train departure, a shunting locomotive must be located to drag the vehicles apart, and any loading or unloading operations taking place at the time are disrupted, wasting time and reducing the overall efficiency of the service to customers.

A further problem with current approaches to coupling is the proliferation of different coupler designs and interface standards, severely reducing the interoperability of different types of rolling stock, or even the same types, on many railway networks. This can result in 'barrier vehicles' having to be used with one type of coupler on one end and a different one on the other end to couple rail vehicles into one train when abnormal movements are required.

In some cases, due to above mentioned difficulties with current coupling methods, especially the unreliability and time-consuming aspects, train operators avoid coupling and uncoupling rolling stock in traffic altogether. As a result, high capacity full length trains are operated at all times, even when demand is light, wasting energy and causing unnecessary wear and tear on both the rail vehicles and the railway track, relative to using shorter train formations, which is more appropriate in these circumstances.

Accordingly, current designs and methods for coupling rail vehicles together, via conventional couplers, are unsatisfactory. Due to limitations of the current coupling systems, trains are unable to easily alter their capacity and rearrange their rail vehicles as required.

SUMMARY OF THE INVENTION

In a first aspect of the invention, there is provided a coupler for coupling rail vehicles together comprising: an extendable coupling body; an extending mechanism; a controller arranged to actuate the extending mechanism; and a support housing for mounting the coupler to a railway carriage, wherein the coupling body and the extending mechanism are mounted within the support housing; wherein the extending mechanism is arranged to be actuated to move the coupling body relative to the support housing any distance between a retracted position and an extended position, the distance between the retracted position and the extended position defining a coupling range of the coupler; wherein the coupling body comprises a coupling interface that is arranged to receive connections of the railway carriage for coupling to a coupling interface of a second coupler; wherein a distance between the coupling interface and the support body increases as the coupling body moves from the retracted position towards the extended position; and wherein the coupling interface is arranged to engage the coupling interface of the second coupler upon contact between the interfaces such that the coupling interface can engage the coupling interface of the second coupler at any distance within the coupling range.

In this way, a pair of rail vehicles having couplers according to the present invention are able to couple together (and uncouple) independent of rail vehicle movement, and no further shunting of the rail vehicles is needed once the rail vehicles are within the coupling range of the couplers.

Preferably, the extending mechanism is substantially cylindrical and mounted to the support housing via a bearing arrangement such that it is constrained axially but may rotate freely relative to the support housing. In this way, the extending mechanism is able to be rotate relative to the support housing.

Preferably, the coupling body comprises a first end having the coupling interface, and an opposing second end; and wherein at least a portion of the coupling body between the first and second end is substantially cylindrical, the extending mechanism substantially encircling, and being in threaded engagement with, the cylindrical portion, and the coupling body being constrained rotationally. In this way, rotation of the extending mechanism causes extension or retraction of the coupling body depending on which way the extending mechanism rotates.

Preferably, the coupler further comprises a drive means that is arranged to rotate the extending mechanism when the drive means is actuated by the controller. In this way, the extending mechanism is able to be rotationally driven, thus causing linear movement of the coupling body.

Preferably, the drive means comprises a locking mechanism that is arranged to prevent rotation of the extending mechanism when the drive means is not being actuated. In this way, axial movement of the coupler can be prevented, which is desirable once the coupler has coupled to another coupler according to the present invention.

Preferably, the drive means is a motor having a pulley that is rotatably coupled to the extending mechanism via a belt.

Preferably, the coupling interface comprises: an inner termination portion which substantially faces the second end and is arranged to receive the connections of the railway carriage; and an opposing outer coupling head, wherein the coupling head comprises: an engaging means that is arranged to reversibly engage a coupling head of the second coupler upon contact between the coupling heads; and coupling contacts that are arranged to couple to the connections of the railway carriage from the termination portion, and reversibly couple to coupling contacts of the second coupler upon engagement between the coupling heads. In this way, the coupling head is able to mechanically couple to the coupling head of another coupler, before the terminated connections of the rail vehicle are coupled to the connections of the other rail vehicle via coupling contacts.

Preferably, the coupling contacts comprise a male set and a female set of contacts. In this way, the total current deliverable by a single electrical interface contact is limited, dividing the total current between the male and the female electrical contacts.

Preferably, the engaging means is shaped such that it aligns with an engaging means of the second coupler during contact between the coupling heads. In this way, the coupling heads can be aligned to allow mechanical engagement to occur between the two, thus also aligning the coupling contacts in the coupling heads to allow coupling between the two.

Preferably, the engaging means is a Scharfenberg cup and cone.

Preferably, the support housing is mounted to the railway carriage via a gimbal frame, the support housing being rotatably mounted to the gimbal frame via a bearing arrangement. In this way, the support housing, and thus the coupling body, is able to sufficiently pivot in a vertical plane to allow for dynamic variations in the height of the two coupled rail vehicles.

Preferably, the gimbal frame is rotatably mounted to the railway carriage via a bearing arrangement. In this way, the gimbal frame, and thus the coupling body, is able to pivot to accommodate sideways movements of the coupling body as the coupled rail vehicles traverse curves in the track.

Preferably, the coupling head further comprises a covering arrangement that is arranged to: cover the coupling head when the coupling body is in the retracted position to protect and/or seal the coupling head; and expose the coupling head when the coupling body is in the extended position. In this way, the coupling contacts and engaging means of the coupling head can be protected and/or sealed when the coupling body is in the retracted position, i.e. when the coupling body is not in use.

Preferably, the gimbal frame is mounted to the railway carriage via a coupler housing, and the coupler housing substantially surrounds the coupling body such that the coupling head is within the coupler housing when in the coupling body is in the retracted position. In this way, the coupler can be stowed away when not in use, i.e. when in the retracted position.

Preferably, the covering arrangement comprises a first and a second elongate cover that are pivotally mounted to the coupling head such that the covers are moveable between an open and a closed position; and wherein in the open position, outer edges of the first and the second cover are substantially flush with the coupling contacts of the coupling head such that the coupling contacts are exposed, and in the closed position, the outer edges of the first and the second cover are in contact with one another such that the coupling head is covered.

Preferably, the first and the second cover comprise a longitudinal projection that is arranged to form a flange against the coupler housing when the coupling body is in the retracted position. In this way, when the coupling body is retracted to within the coupler housing, the flanges cover upper and lower clearances between the coupling body and the housing. Thus, the coupling body is well sealed against hazards such as snow, which tends to penetrate the coupling mechanisms in conventional coupler designs, which reduces the reliability of these couplers.

Preferably, the first and the second cover are held in a neutral position between the open and closed positions, and the coupler housing comprises housing projections that are arranged to engage the covers as the coupling body moves into the retracted position such that the covers are biased towards one another and move into the closed position.

Preferably, the first and the second cover are arranged to move from the neutral position into the open position upon contact with a first and a second cover of the second coupler.

Preferably, the first and the second cover comprise sensors that are arranged to detect movement of the covers from the neutral position to indicate the proximity of the second coupler.

Preferably, the connections of the railway carriage comprise a first set of connections and a second set of connections; and wherein the second end comprises an opening into the coupling body, and the termination portion is arranged to receive the first set of connections via the opening. In this way, the first set of connections are mostly contained within the coupling body (more so when the coupling body is in the retracted position), thus protecting the first set of connections from adverse environmental exposure, such as debris, rain etc.

Preferably, the support housing comprises longitudinal beams that receive, and are substantially parallel with, the coupling body; and wherein the coupling body has longitudinal grooves that face the beams, and the beams have longitudinal protrusions that are arranged to engage the grooves to permit axial but restrict rotational movement of the coupling body. In this way, the coupling body can be extended or retracted via rotation from the extending mechanism.

Preferably, the beams are mounted together at an end distal from the support housing via a plate, and the opening is arranged to receive the first set of connections via the plate.

Preferably, the first set of connections coupled between the termination portion and the plate are arranged in a spiral formation to allow extension and retraction of the first set of connections. In this way, the first set of connections are able to extend and retract in tandem with the coupling body.

Preferably, the termination portion and the second end protrude radially relative to a longitudinal line of the coupling body, and the protruding portion of the termination portion is arranged to receive the second set of connections via the protruding portion of the second end. In this way, the second set of connections are able move in tandem with the coupling body as it is extended or retracted.

Preferably, the first set of connections comprise at least one or more of low-power electrical connections, pneumatic connections and optical connections; and wherein the second set of connections are high-power electrical connections.

Preferably, the deliverable current of the electrical connections is arranged to be split between the male and the female set of contacts. In this way, the total current deliverable by a single electrical interface contact is limited, dividing the total current between the male and the female electrical contacts.

Preferably, the second set of connections comprise conductive rods that are mounted between the protruding portions of the termination portion and the second end, and coupled at the second end to a hotel bus of the railway carriage.

Preferably, the rods are coupled to the hotel bus via rod contacts that are arranged to be switched between engaging and disengaging the rods. In this way, the rods can be electrically connected or disconnected, from the hotel bus, via switching the rod contacts to engage or disengage the rods respectively.

Preferably, the rod contacts are mounted to the support housing via an insulated frame.

Preferably, the insulated frame comprises brushes that contract the rods such that movement of the rods relative to the brushes removes oxidation from the rods.

Preferably, the second end is an insulated plate.

A distance between the retracted position and the extended position defines a coupling range of the coupler, and the coupling interface is arranged to engage the coupling interface of the second coupler at any distance within the coupling range. In this way, the coupler allows for a substantial range of inter-vehicle spacing. When rail vehicles have stopped further apart than intended, the couplers extend further to accommodate this extra distance. Conversely, if braking was left a little later than intended and the stopped rail vehicles are closer together, the couplers extend a shorter distance. Thus, the coupler is able to accommodate a wide variety of operating conditions of the rail vehicles, as it has a variable coupling distance. The coupler does not have to reach the extended position (i.e. be fully extended) for the coupler to engage and couple to another coupler of the present invention.

Preferably, the controller is further arranged to operate the coupling interface, and communicate with a controller of the second coupler, wherein the controllers are arranged to synchronise the coupling and decoupling of the coupling interface with a coupling interface of the second coupler. In this way, coupling between a pair of couplers can be synchronised.

In a second aspect of the invention, there is provided a method of controlling a first coupler, comprising the steps of: receiving a request to couple command from a second coupler; transmitting an agreement to couple command to the second coupler; extending the coupling body from the retracted position towards the extended position; causing the coupling interface to engage the coupling interface of the second coupler upon contact between the interfaces; and connecting at least a portion of the connections of the railway carriage to the coupling interface of the second coupler.

In this way, the coupling and decoupling process of the coupler can be controlled.

Preferably, the method further comprises the steps of: receiving a request to uncouple command from the second coupler; transmitting an agreement to uncouple command to the second coupler; disconnecting the connections of the railway carriage from the coupling interface of the second coupler; causing the coupling interface to disengage the coupling interface of the second coupler; and retracting the coupling body towards the retracted position.

Preferably, a speed of the extension of the coupling body is reduced upon contact between the coupling interface and the coupling interface of the second coupler; and wherein a speed of the retraction of the coupling body is increased as the coupling interface no longer contacts the coupling interface of the second coupler. In this way, more time is provided for the coupling heads to align, any transient movement in the rail vehicles when coupling takes place can be accommodated. Further, the overall time of the coupling and uncoupling process can be optimised, as the extension and retraction of the coupling body when the coupling head is not coupling or uncoupling from another coupling head is increased, which is desirable.

Preferably, extension of the coupling body is stopped upon engagement between the coupling interface and the coupling interface of the second coupler; and wherein retraction of the coupling body begins upon disengagement between the coupling interface and the coupling interface of the second coupler. In this way, axial movement of the couplers can be prevented once the couplers have coupled together.

Preferably, the coupler is switchable between a locked state and an unlocked state; wherein, in the locked state, commands received from the second coupler are disregarded; and wherein, in the unlocked state, commands received from the second coupler are not disregarded. In this way, the coupler can be locked when a train formation has been completed, providing additional security against picking up false commands due to mistaken actions by staff, software errors, or stray communications from nearby trains, etc.

Preferably, operation of at least one of: the coupling interface and the extending mechanism generates an event to alert an operator of the coupler. In this way, users of the coupler are alerted when coupling and uncoupling of the coupler is occurring, allowing useful auxiliary functions of the coupler to be implemented in response to this alert.

BRIEF DESCRIPTION OF THE DRAWINGS

Embodiments of the invention will now be described by way of example, with reference to the drawings in which: —

FIG. 2*a* illustrates a perspective view, FIG. 2*b* illustrates a transverse cross-sectional view and FIG. 3*b* illustrate a longitudinal cross-sectional view;

FIGS. 3*a* and 3*b* illustrate a perspective view of the mechanism for providing the interface connections of a rail vehicle, in particular FIG. 3*a* illustrates the mounting arrangement of spiraled and high-power connections, and FIG. 3*b* illustrates the rod contacts for the high-power conductive rods;

FIGS. 8*a* and 8*b* show the shields in a closed and open position respectively, FIGS. 8*c* to 8*e* show the transition of the shields from the closed to the open position, as well as the biasing arrangement of the shields;

FIG. 10*a* illustrates a stationary rail vehicle being approached by another rail vehicle, FIG. 10*b* illustrates the other rail vehicle stopping proximate to the stationary rail vehicle, FIGS. 10*c* and 10*d* illustrate the exchange of coupling signals between the rail vehicles, FIG. 10*e* illustrates the coupler of each rail vehicle extending toward one another, FIG. 10*f* illustrates the couplers engaging one another, and FIGS. 10*g* and 10*h* illustrate the couplers engaging one another when the rail vehicles are at a shorter distance and a longer distance respectively than the vehicles in FIG. 10*f*.

DETAILED DESCRIPTION

Figure 1:
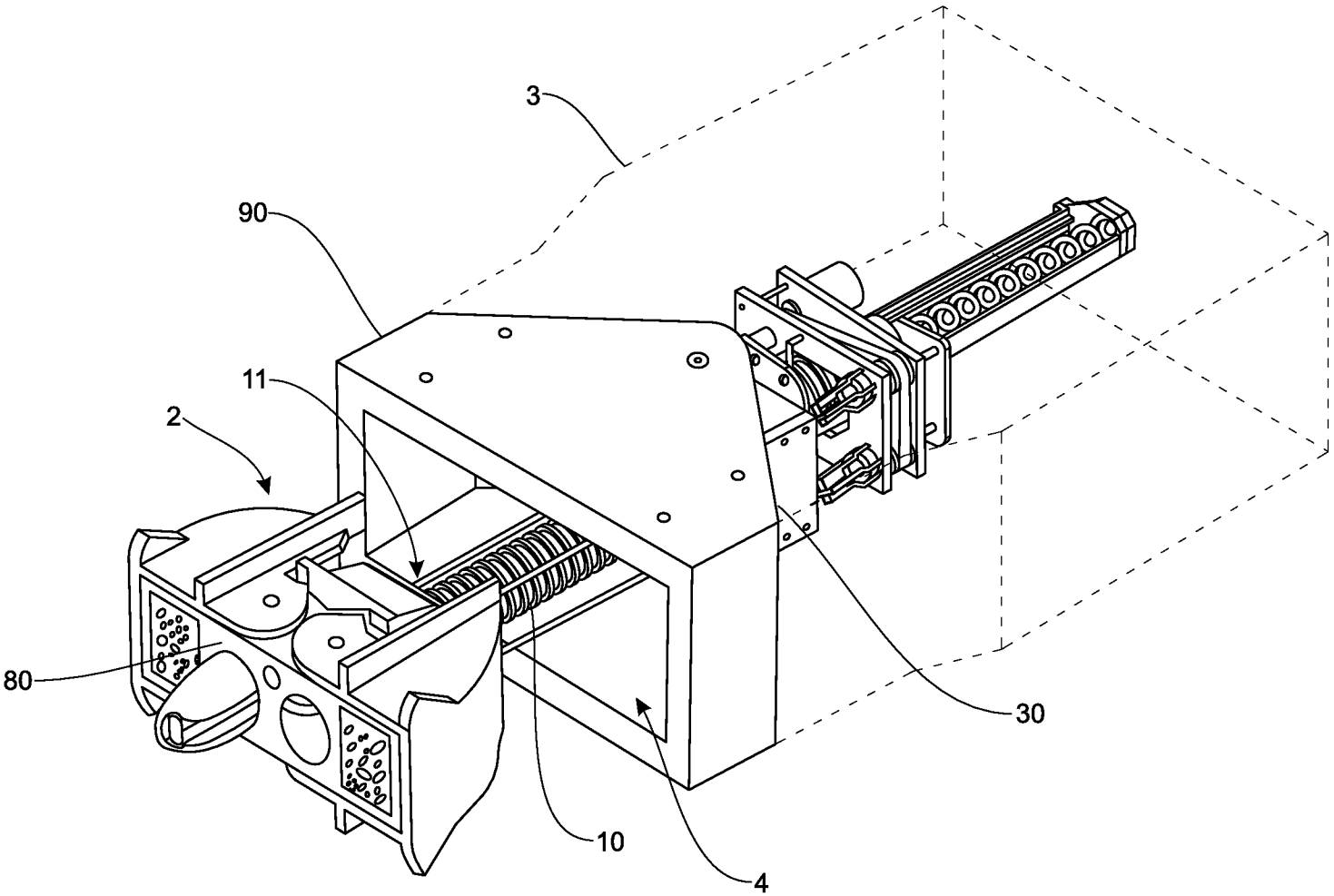
FIG. 1 illustrates a perspective view of a coupler according to the present invention.

FIG. 1 illustrates an embodiment of a coupler 2 according to the present invention. The coupler 2 is suitable for mounting to a rail vehicle to provide an interface for the engagement and coupling of rail vehicles and their various interface connections over a variable distance.

In this embodiment, the coupler 2 comprises an extendable tube 10, and other associated components, that are mounted within a housing 90. The housing 90 is arranged to be mounted to the, preferably flat, underside of a rail vehicle (not shown) to mount the coupler 2 to a rail vehicle.

An outer end 11 of the tube 10 comprises a coupling head 80, which is configured to terminate various interface connections of the rail vehicle that the coupler 2 is mounted to, for subsequent coupling to another coupler (according to the present invention) that is mounted to another rail vehicle. The coupling head 80 is arranged to engage a coupling head of another coupler upon (or after) contact between the two. In this way, a pair of rail vehicles, and their various interface connections, can be coupled (or connected) together via a pair of couplers according to the present invention. The configuration of the coupler head 80, and the engagement and coupling process, will be described in detail later on.

Henceforth, in this document, the term 'another coupler' and 'other coupler' mean another coupler according to the present invention that is mounted to another rail vehicle.

The tube 10 passes through an opening 4 in the housing 90 and comprises an extending mechanism that is arranged to cause linear motion of the tube 10 (along a longitudinal length of the tube 10). In this way, the tube 10, and thus the coupler head 80, can be extended from within the housing 90 for engaging/coupling with another coupler, and retracted to within the housing 90 after disengaging/decoupling from another coupler.

Figure 2:
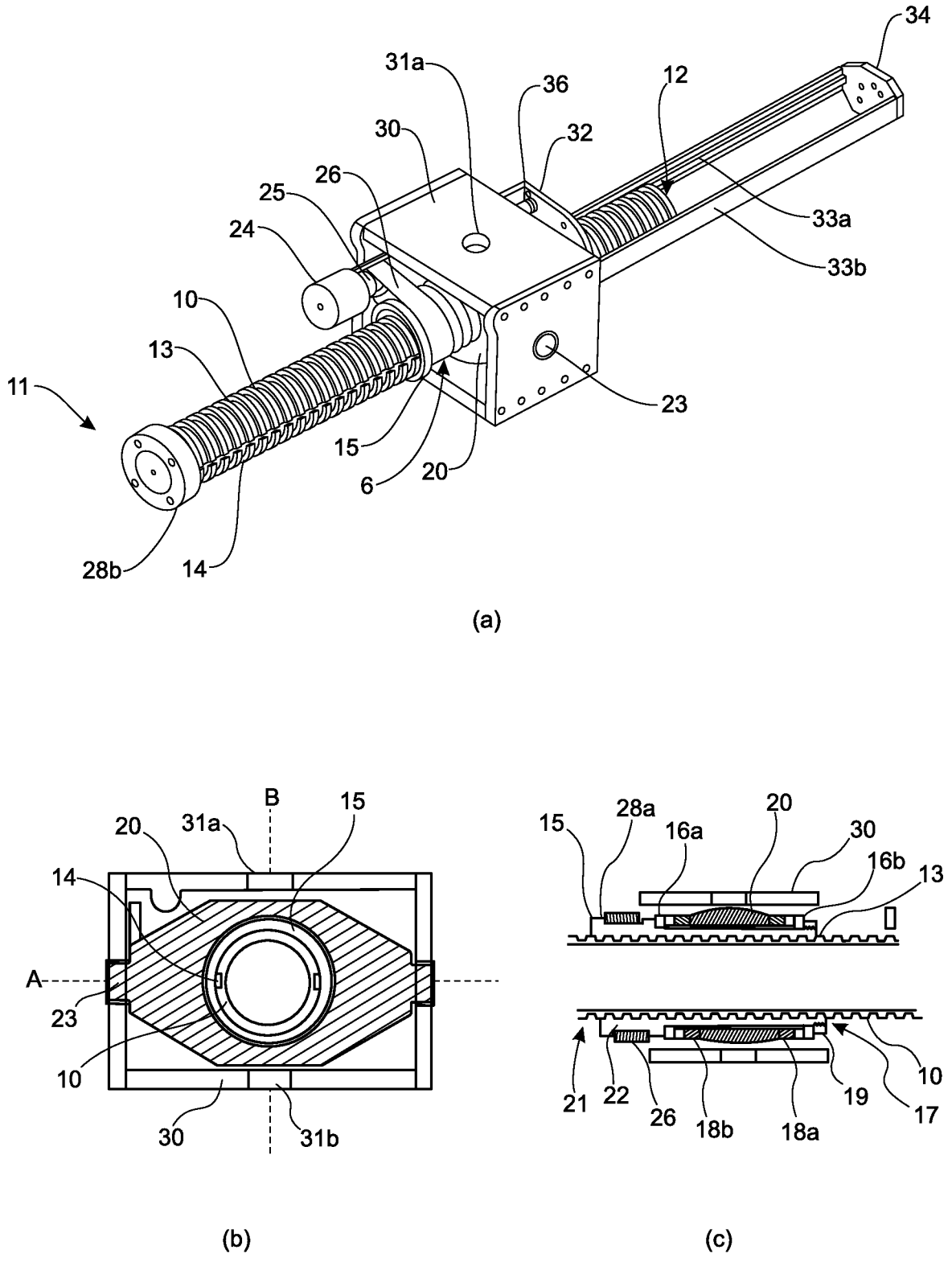
FIGS. 2*a*, 2*b* and 2*c* illustrate the extending mechanism of the coupler, in particular

The structure and function of the extending mechanism 6 will now be described in relation to FIGS. 2*a*, 2*b*, and 2*c*—these figures illustrate the coupler 2 without the housing 90 or the coupler head 80. The extending mechanism 6 comprises a rotatable cylinder 15 that substantially encircles, and is in threaded engagement with, the tube 10 via a thread 13 on an outer surface of the tube 10 that is received by complementary shaped threading on an inner surface of the cylinder 15—the cylinder 15 is substantially concentric with the tube 10. In this embodiment, the thread 13 is a spiral square section, and most of the outer surface of the tube 10 comprises the thread 13. In other embodiments, only a central circumferential portion of the tube 10 may comprise the thread 13.

The cylinder 15 passes through a support block 20, which has a central hole with sufficient clearance to receive the cylinder 15. An outer end 21 of the cylinder 15 comprises a flange 28*a* which supports a non-static side of a first thrust bearing 16*a*. An inner end 17 of the cylinder 15 comprises a collar 19 which supports a non-static side of a second thrust bearing 16*b*. The static sides of the thrust bearings 16*a*, 16*b* are supported by resilient elastomeric rings 18*a*, 18*b*, the rings 18*a*, 18*b* being contained in wide recesses at each end of the support block 20 (seen best in FIG. 2*c*). In this way, the cylinder 15 is mounted to the support block 20, via the thrust bearings 16*a*, 16*b*, such that it is constrained axially, but may rotate freely (along a longitudinal length of the cylinder 15) relative to the support block 20.

The support block 20 is provided with robust cylindrical extensions 23, which form bearings to allow pivoting of the support block 20 (along the horizontal axis A) within a gimbal frame 30. This allows the support block 20, and thus the tube 10, to sufficiently pivot in a vertical plane to allow for dynamic variations in the height of the two coupled rail vehicles.

An inner side of the support block 20 comprises a bracket 32. The bracket 32 comprises longitudinal beams 33*a*, 33*b* which receive, and are substantially parallel with, the tube 10, and with one another. In this embodiment, the beams 33*a*, 33*b* are separate components having outer ends that are supported by, and mounted to, the bracket 32. In other embodiments, the beams 33*a*, 33*b* may be integral with the bracket 32.

Each beam comprises a longitudinal rib that runs the length of the beam and faces the tube 10. The tube 10 has longitudinal grooves 14 either side of the tube 10 that receive the ribs of the beams 33*a*, 33*b*. In this way, the tube 10 is constrained rotationally but allowed to move axially (along a longitudinal length of the tube 10). In other words, the tube 10 is constrained rotationally by the support block 20, or more specifically by the beams 33*a*, 33*b* of the bracket 32.

The arrangement between the ribs and the grooves 14 provides some clearance, but it is sufficient to prevent the extendable tube 10 from rotating significantly, thus maintaining correct orientation of tube 10 for suitable connection of the interface connections of the rail vehicle, as will be described later on.

Inner ends of the beams 33*a*, 33*b* (furthest from the support body 20) are joined via an end plate 34 which, as will be described later on, is the reception point for various services carried within the extendable tube 10. This arrangement ensures that the beams 33*a*, 33*b* are kept in the correct longitudinal alignment with the extendable tube 10.

The shape of bracket 32 provides clearance for assembling the cylinder 15 inside the supporting block 20, and also for assembling the collar 19 onto the cylinder 15, which is achieved via screwing the collar 19 over the cylinder 15.

The elastomeric rings 18*a*, 18*b* are compressed between the thrust bearings 16*a*, 16*b* and the support block 20. The degree to which the rings 18*a*, 18*b* are compressed is determined by how far the collar 19 is screwed onto the movement cylinder 15. The degree of resilience of this arrangement can thus be adjusted to give specified small movements of the coupler 2 under the influence of particular traction or retardation forces through it, before locking the collar 19 in the desired position.

A circumferential portion of the cylinder 15 proximate to the outer end 21 of the cylinder 15 comprises teeth to form an integral toothed pulley 22. In other embodiments, the toothed pulley 22 may not be integral with the cylinder 15, but instead be a separate component that is mounted to the circumferential portion of the cylinder 15.

An extension motor 24 is mounted to the support block 20 via a bracket arrangement. The motor 24, which may be operated electrically or pneumatically, is equipped with a small diameter toothed pulley 25. The motor pulley 25 is rotationally coupled to the integral toothed pulley 22 of the cylinder 15 via a toothed belt 26. Therefore, rotation of the motor 24 causes rotation of the cylinder 15—the motor 24 serves as a means to drive the cylinder 15 when the motor 24 is actuated. In this way, the motor 24 is able to provide rotational drive to the cylinder 15, which in turn, causes linear motion of the tube 10.

Linear motion of the tube 10 occurs, upon rotation of the cylinder 15, because the cylinder 15 is constrained axially but may rotate freely relative to the support block 20, the tube 10 is rotationally constrained via the beams 33*a*, 33*b*, and the tube 10 is in threaded engagement with the cylinder 15.

The direction of the linear motion of the tube 10 depends on the direction the motor 24, and thus the cylinder 15, is rotating. Operating the extension motor 24 thus causes the extendable tube 10 to move relative to the support block 20, either extending the outer end 11 away from the support block 20, or retracting the outer end 11 towards the support block 20, depending on the direction of rotation of the motor 24.

The tube 10 is somewhat longer than its extension range (i.e. longer than the range between the retracted position and the extended position). The outer end 11 of the tube 10 comprises a flange 28*b* for mounting the coupler head 80 (not shown in FIG. 2*a*) to the tube 10. An inner end 12 of the tube 10 comprises mounting holes in its surface for the mounting of an insulator plate, as will be described later on.

The extension motor 24 is arranged to ensure that its spindle is locked in position and cannot rotate when power is not being applied to the motor 24, i.e. when the motor 24 is not being actuated. This ensures that when the desired position of the tube 10 has been reached and the extension motor 24 stops, the extendable tube 10 is fixed in position relative to supporting block 20, and will not move under the influence of vibration and the substantial forces which may be applied to it when in use. The skilled person will understand how the extension motor 24 is arranged to ensure its spindle is locked in position when power is not being applied to the motor 24. For example, a tooth operated by an electromagnet engages with a gear wheel on the shaft of the motor 24 when power is not being applied to the motor, thus preventing the shaft from rotating.

The tube 10 is configured such that limit positions of the tube 10 can be detected to stop the motor 24 when these positions have been reached. In this way, an extendable range of the tube 10 can be determined and controlled. This is achieved via a sensing arrangement that is able to detect when the tube 10 reaches a fully extended limit position and a fully retracted limit position. In this embodiment, the sensing arrangement is a pair of microswitches having rollers which contact the bottom of one of the grooves 14 of the tube 10. The rollers are compressed, and released when encountering small holes or depressions at the appropriate limit positions. The release of the rollers causes the motor 24 to stop. In other words, one switch is arranged to sense the fully retracted position, when the coupler 2 is out of use, and the other switch is arranged to sense the fully extended position of the tube 10. In this way, the extendable range of the tube 10 can be determined during manufacture of the coupler 2. In other embodiments, the sensing arrangement may not be a pair of microswitches, but instead be some other suitable sensor that is able to detect limit positions of the tube 10 to stop the motor 24.

The fully extended position of the tube 10 will not normally be reached in operation, as a pair of couplers according to the present invention will have joined and stopped the extension motor 24 before the fully extended position is reached.

However, this position might be encountered under test conditions for servicing, or when two rail vehicles intended to be coupled have been mistakenly stopped too far apart.

The gimbal frame 30 is substantially rectangular and comprises bearing arrangements 31*a*, 31*b* on its upper and lower faces, which permit the gimbal frame 30, and thus the tube 10, to pivot (along the vertical axis B) to accommodate sideways movements of the tube 10 as the coupled rail vehicles traverse curves in the track. In effect, the gimbal frame 30, along with the support block 20, allows the coupler 2 to pivot in any direction about a central point (i.e. at the intersection of axis A and axis B).

In this embodiment, the bearings 31*a*, 31*b* are mounted robustly to the rail vehicle structure via the housing 90. The housing 90 supports the bearings 31*a*, 31*b*. Therefore, the robust housing 90 carries the traction and retardation forces between the coupler 2 and the rail vehicle the coupler 2 is mounted to. Other mounting arrangements are possible depending on the rail vehicle structure. In some embodiments, there may be no housing 90, and the gimbal frame 30 may be mounted directly to the rail vehicle. The mounting arrangement will depend on the design of the rail vehicle, but will be sufficient to bear the maximum traction and braking forces the coupler 2 is able to accommodate.

A compression spring 36 is inserted between the supporting block 20 and the bracket 32 such that when the coupler head 80 is extended to a distance midway between the two limit positions, the weight of the components of the coupler head 80 is counteracted, and the tube 10 is encouraged to remain substantially parallel to its longitudinal axis, rather than tipping downwardly at the outer end 11 such that the tube 10 remains in the vertical pivoting limit. Further, this arrangement also ensures that when the coupler 2 is retracting from an extended position towards the fully retracted position, the shifting centre of gravity of the tube 10 will tend to cause the coupler head 80 to rise and the inner side of the extension mechanism 6 to fall, giving greater clearances between the underside of the rail vehicle body and the extension mechanism 6. A damper (not shown) is fitted within the spring 36 to limit oscillations of the spring 36 that may occur during use.

The tube 10, cylinder 15 and support block 20 comprise a structurally robust material, such as metal.

The coupling of the interface connections of the rail vehicle with the coupler 2 will now be described. In this embodiment, there are three types of interface connection that are arranged to be terminated in the coupler head 80 for subsequent coupling to another coupler. These types of interface connections are electrical connections, pneumatic connections and optical connections.

More specifically, in this embodiment, these interfaces connections comprise: compressed air (for brakes, suspensions, doors etc.); power and control wires for ECP brakes; target speed and acceleration/deceleration controls; a train information bus (interface to train management computers); bell signals between on-train staff; door release and locking controls (each side of train); a digital data bus (video cameras, audio links, alarm messages, feeds to WiFi routers, future facilities, etc.); coupling event signals; and a hotel bus (air conditioning, lights, on-train facilities etc.). Other embodiments may comprise additional, or less, interface connections depending on the type of rail vehicle the coupler 2 is designed to be mounted to.

The skilled person will understand that the above-mentioned interface connections are the main types of interface connection that are required to be coupled together when coupling a pair of rail vehicles together. The skilled person will understand that the above-mentioned interface connections is not an exhaustive list, and there may be a number of additional auxiliary interface connections that must be coupled, depending on the type of rail vehicle or the facilities provided within the vehicle. The coupler 2 of the present invention is able to accommodate these various auxiliary connections, but it is beyond the scope of this document to provide an exhaustive list of these types of interface connections, and therefore the main types of interface connection are described.

Henceforth, the term 'connections' means the interface connections of a rail vehicle.

Figure 3:
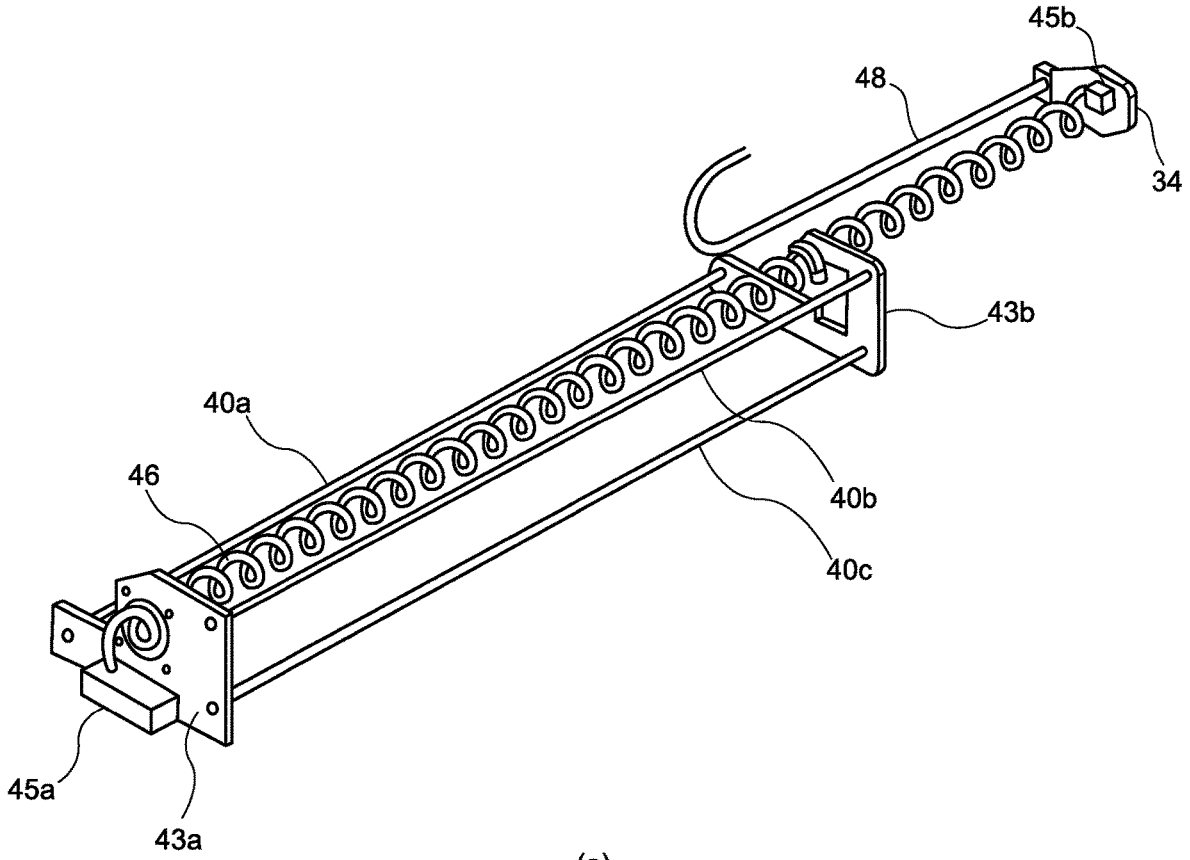
Figure 3:
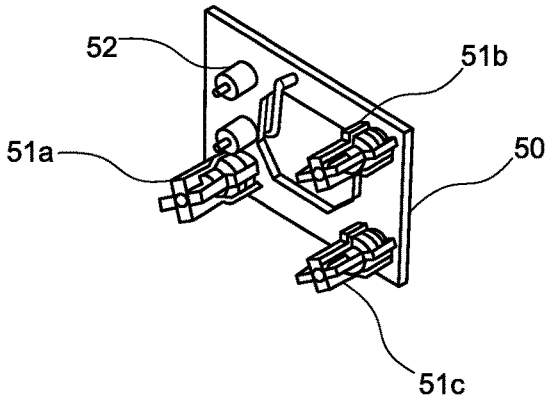

As illustrated in FIG. 3*a*, the connections are divided into a first set of connections and a second set of connections. The first set of connections comprise low-power electrical connections, pneumatic connections and optical connections (i.e. all of the connections listed above except for the hotel bus). The second set of connections comprise high-power electrical connections, such as the hotel bus.

The widely varying distances the first set of connections must travel to and from the coupler 80 head is accommodated by arranging these connections in a flexible spiral formation as described in the application EP3590785A1, which is incorporated herein by reference. In particular, a flexible spiral connector 46 comprises a corresponding spiral tube that is contained within an outer sheath.

The spiral tube comprises compressed air and serves as the pneumatic connection. In this way, the spiral tube, and thus the spiral connector 46, is extensible, and is therefore able to extend and retract.

The spiral tube containing the compressed air provides a supporting structure for the low-power electrical connections, such as electrical wires, and the optical connections, such as optical fibres, to be attached to. The low-power electrical connections and optical connections are attached to an outer surface of the spiral tube. This attachment may be achieved by wrapping the electrical wires and optical fibres around the spiral tube, and/or by embedding them in flexible material surrounding the spiral tube. The air pressure within the spiral tube helps to stabilise the structure of the spiral tube such that the movements of the low-power electrical and the optical connections are somewhat constrained (i.e. do not excessively sag) but can be extended and retracted in tandem with the spiral tube without snagging or kinking. The outer sheath of the spiral connector 46 envelops and protects the first set of connections (i.e. the spiral tube, the low-power connections and the optical connections).

In addition to the first set of connections, electrical connections relating to the operation of the coupler 2 which pass between the coupler head 80 and the rail vehicle are also included within the spiral connector 46.

Secured to both the outer end 11 and the inner end 12 of the extendable tube 10 are insulator plates 43*a*, 43*b* (the extendable tube 10 is not illustrated in FIG. 3*a*). As the plates 43*a*, 43*b* are secured to the ends 11, 12 of the tube 10, they substantially face one another.

In this embodiment, the plate 43*a* is part of the coupler head 80. In some embodiments, the plates 43*a*, 43*b* may be integral with the ends 11, 12 of the tube 10, rather than separate components that are mounted to the ends.

The insulator plate 43*a* and the end plate 34 each support a termination box 45*a*, 45*b*. The first set of connections are first received from various connections points in the rail vehicle by the termination box 45*b*, where they are terminated. The connections pass from the rail vehicle to the termination box 45*b* via a flexible covering sheath 48.

The sheath 48 is secured to one of the beams 33*a*, 33*b* proximate to the gimbal frame 30. Securing the sheath 48 proximate to the gimbal frame 30 allows the flexibility of the connections to follow the small relative movements between the rail vehicle body and the extension mechanism 6 when the coupler head 80 swivels to accommodate rail vehicle movements on a curved track.

The spiral connector 46 passes through an opening in the insulator plate 43*b*, and is mounted between the insulator plate 43*a* and the end plate 34. More specifically, one end of the spiral connector 46 passes through an aperture in the insulator plate 43*a* and is terminated at the termination box 45*a*, and the other opposing end of the spiral connector 46 is terminated at the termination box 45*b*.

Although not viewable from FIG. 3*a*, the portion of the spiral connector 46 that passes between the plates 43*a*, 43*b* is contained within the extendable tube 10.

The terminated first set of connections at the termination box 45*b* (i.e. received from the rail vehicle) are coupled to their respective connections within the spiral connector 46, which are in turn terminated and separated out at the termination box 45*a* for coupling/connection to the coupler head 80 (not shown in FIG. 3*a*). In other words, the termination box 45*a* is arranged to receive and terminate the first set of connections via the end plate 34 and the opening in the insulator plate 43*b*.

Consequently, the end of the spiral connector 46 mounted to the insulator plate 43*a* follows the movements of the coupler head 80 in any direction, including its extension and retraction, whereas the end of the spiral connector 46 that is mounted to the end plate 34 is a fixed distance from the pivot point in the centre of the gimbal frame 30, and is able to move sideways and vertically, but is restricted axially. The spiral connector 46 therefore accommodates extension and retraction movements only, being located mostly within the extension tube 10 and partly free outside it as determined by the degree of extension, and is a secure arrangement that is able to cope with a high degree of vibration and transient movements of the rail vehicle.

The spiral arrangement of electrical connections within the spiral connector 46 is sufficient for low level signals and modest amounts of electrical power that require relatively thin conducting wires. However, this arrangement is not suitable for integrating high-power electrical connections, because relatively thick wires/cables are typically required to transfer large amounts of electrical power—these thicker wires would be difficult to integrate with the spiral formation of the other, thinner connections.

As described above, the second set of connections comprise high-power electrical connections for supplying electrical power for heating, lighting, air conditioning and other such on-train services. More specifically, the second set of connections comprise three conductive rods 40*a*, 40*b*, 40*c* that are mounted between the insulator plates 43*a*, 43*b*.

The insulator plates 43*a*, 43*b* protrude radially from the ends 11, 12 of the tube such that the rods 40*a*, 40*b*, 40*c* are mounted between the plates 43*a*, 43*b* outside of the tube 10, the extending mechanism 6 and the support block 20—the rods 40*a*, 40*b*, 40*c* pass between the support block 20 and the gimbal frame 30.

A corner of the plate 43*a* is recessed to accommodate the position of the motor 24 when the tube 10 is being moved between the extended and retracted positions. The insulator plate 43*b* also has a corner removed to clear the contactor motor 65 (to be described) and further cut-away sections to accommodate the beams 33*a*, 33*b* upon movement of the tube 10. In some embodiments, the plates 43*a*, 43*b* may not have a corner recessed, and the motors 24, 65 may be mounted to the coupler 2 such that they do not interfere with the plates 43*a*, 43*b*.

The rods 40*a*, 40*b*, 40*c* pass through an insulated contact frame 50, which is illustrated separately in FIG. 3*b*. The contact frame 50 is mounted to the bracket 32 via a resilient mounting arrangement 52. The contact frame 50 comprises three sets of electrical rod contacts 51*a*, 51*b*, 51*c*, which each receive a rod 40*a*, 40*b*, 40*c*—each rod 40*a*, 40*b*, 40*c* passes through a respective electrical rod contact 51*a*, 51*b*, 51*c*. In some embodiments, less preferably, the contact frame 50 may instead be three separate frames, one for each rod.

The rod contacts 51*a*, 51*b*, 51*c* are arranged to supply electrical power from the hotel bus of the rail vehicle to the rods 40*a*, 40*b*, 40*c*, and are configured to switch between physically engaging their respective rods 40*a*, 40*b*, 40*c*, or disengaging their respective rods 40*a*, 40*b*, 40*c*. In this way, the rod contacts 51*a*, 51*b*, 51*c* are able to connect or disconnect electrical power to the rods 40*a*, 40*b*, 40*c* from the hotel bus.

As the contact frame 50 is indirectly attached to the support block 20, it follows all angular movements of the extension mechanism 6 and remains in correct alignment with the rods 40*a*, 40*b* and 40*c*. Any transient changes in the traction or braking forces of the rail vehicle, when in use, causing movement of the extendable tube 10 relative to the supporting block 20 (due to compression or expansion of the rings 18) will also cause similar movement of the contact frame 50, due to the relatively compliant resilient mounting arrangement 52. In other words, when the rod contacts 51*a*, 51*b*, 51*c* are engaging their respective rods 40*a*, 40*b*, 40*c*, the rod contacts 51*a*, 51*b*, 51*c* remain securely clamped to the rods 40*a*, 40*b*, 40*c* and are not displaced axially when in use, avoiding wear and tear on the rod contacts 51*a*, 51*b*, 51*c* which would result from any sliding movements relative to the rods 40*a*, 40*b*, 40*c*.

Figure 4:
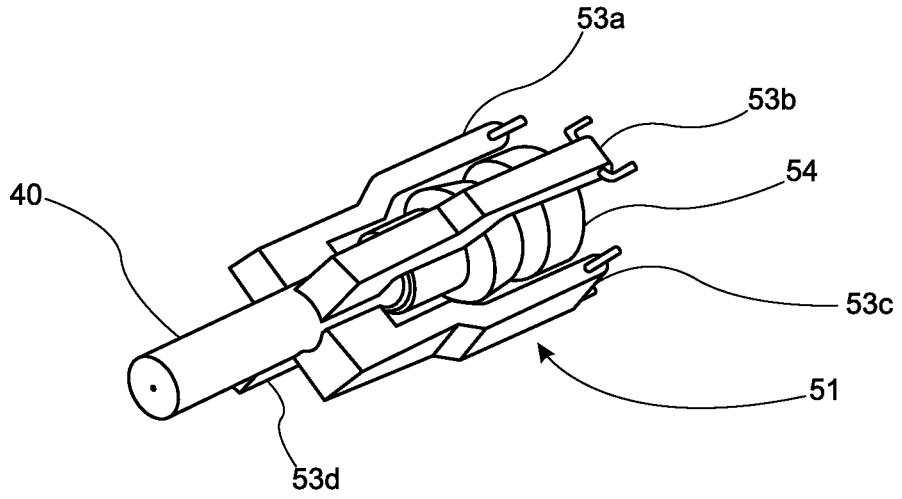
FIGS. 4*a* and 4*b* illustrate a magnified perspective view of the rod contacts in FIG. 3*b*, FIG. 4*a* illustrating engaged contacts and FIG. 4*b* illustrating disengaged contacts.
Figure 4:
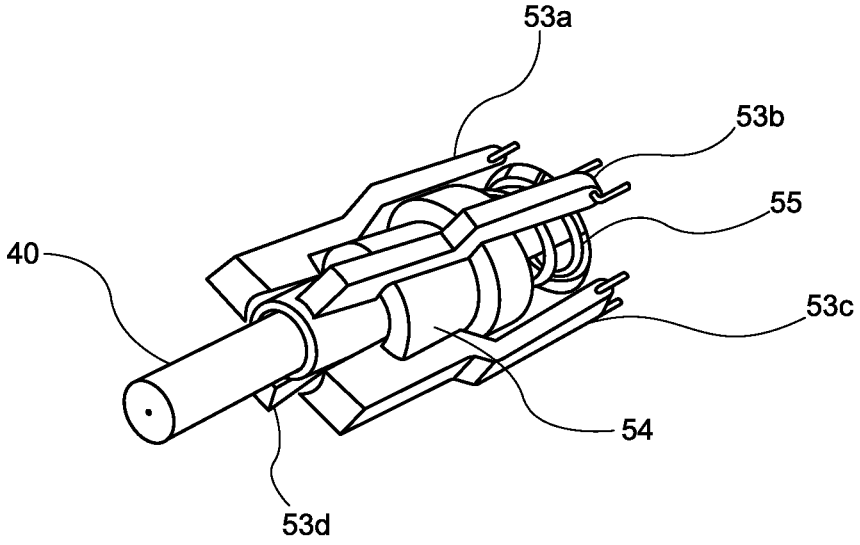

FIGS. 4*a* and 4*b* illustrate one of these rod contacts 51—the rod contacts 51*a*, 51*b*, 51*c* are substantially the same in structure and in function. The rod contact 51 comprises four sprung contacts 53*a*, 53*b*, 53*c*, 53*d* arranged radially beyond the rod 40.

The sprung contacts 53*a*, 53*b*, 53*c*, 53*d* are biased (a circlip type configuration surrounding all four contacts in an appropriate position for the desired pressures) such that they are displaced towards and engage the rod 40. Outer ends of the sprung contacts 53*a*, 53*b*, 53*c*, 53*d* have concave mating surfaces with significant surface area to allow the sprung contacts 53*a*, 53*b*, 53*c*, 53*d* to firmly grasp the rod 40 with a relatively large contact area. The sprung contacts 53*a*, 53*b*, 53*c*, 53*d* are spaced equidistantly such that contact areas can be formed on all sides of the rod 40 to allow a more equal distribution of current to the rod 40 from the sprung contacts 53*a*, 53*b*, 53*c* when the sprung contacts are engaging the rod 40—each sprung contact supplies a quarter of the total current provided by the hotel bus of the rail vehicle. In some embodiments, the sprung contacts 53*a*, 53*b*, 53*c*, 53*d* may not be spaced equidistantly.

Flexible cables are coupled to each sprung contact 53*a*, 53*b*, 53*c*, 53*d* and to a connecting block attached to the rail vehicle, which recombines the four current flows of each sprung contact for subsequent connection to the corresponding hotel bus line passing through the rail vehicle. In this way, the hotel bus of a rail vehicle is coupled to the sprung contacts 53*a*, 53*b*, 53*c*, 53*d*, which in turn couple the hotel bus to the rod 40. Since the contact frame 50 is near the pivot point of the gimbal frame 30, the relative movements that must be accommodated by the flexible cables are relatively small. In some embodiments, there may be more or less than four sprung contacts.

Therefore, the rods 40*a*, 40*b*, 40*c* are arranged to provide a three-wire high-power electrical distribution system, which is preferably centre tapped to provide a single-phase three wire AC voltage supply.

In this embodiment, the hotel bus provides a 2000V AC voltage supply at 50 or 60 Hz having a 200 A current capacity. One of the rods forms the centre tap, which is typically grounded, while each of the other rods provide a 1000V supply. In some embodiments, there may be only two rods to provide a conventional single voltage supply.

FIG. 4*a* illustrates the sprung contacts 53*a*, 53*b*, 53*c*, 53*d* grasping the rod 40. Contact between the sprung contacts 53*a*, 53*b*, 53*c*, 53*d* and the rod 40 can be broken/prevented by interposing an insulator 54 between the rod 40 and the mating surfaces of the sprung contacts 53*a*, 53*b*, 53*c*, 53*d*, which is illustrated in FIG. 4*b*. In this case, the insulator 54 displaces the sprung contacts 53*a*, 53*b*, 53*c*, 53*d* against their biasing, thus prising the contacts away from the rod 40 such that the insulator is interposed between the rod 40 and the sprung contacts 53*a*, 53*b*, 53*c*, 53*d*, electrically insulating the rod 40 from the contacts.

In this embodiment, the insulator comprises a ceramic material. In other embodiments, the insulator 54 may be comprise an alternative suitably insulating material.

The insulator 54 is mounted to, and encircles, the rod 40. The shape of the insulator 54 is configured to provide a 'latching' action between the two when the insulator 54 is interposed between them.

The contact frame 50 comprises a hotel bus control mechanism for controlling the electrical connection (and the electrical disconnection) of the hotel bus to the rods 40*b*, 40*c*. The hotel bus control mechanism is arranged to reversibly displace the insulator 54 between a retracted position, allowing engagement between the rod 40 and the sprung contacts 53*a*, 53*b*, 53*c*, 53*d*, and the interposed position, preventing engagement between the rod 40 and the sprung contacts 53*a*, 53*b*, 53*c*, 53*d*. In this way, the insulator 54 can occupy two stable positions: a 'connected' position and a 'disconnected' position as illustrated by FIG. 4*a* and FIG. 4*b* respectively.

In other words, FIG. 4*a* illustrates the rod contact 51 in the engaged or connected state, to allow the supply of electrical power from the hotel bus to the rod 40, and FIG. 4*b* illustrates the rod contact 51 in the disengaged or disconnected state, preventing the supply of electrical power from the hotel bus to the rod 40.

Figure 5:
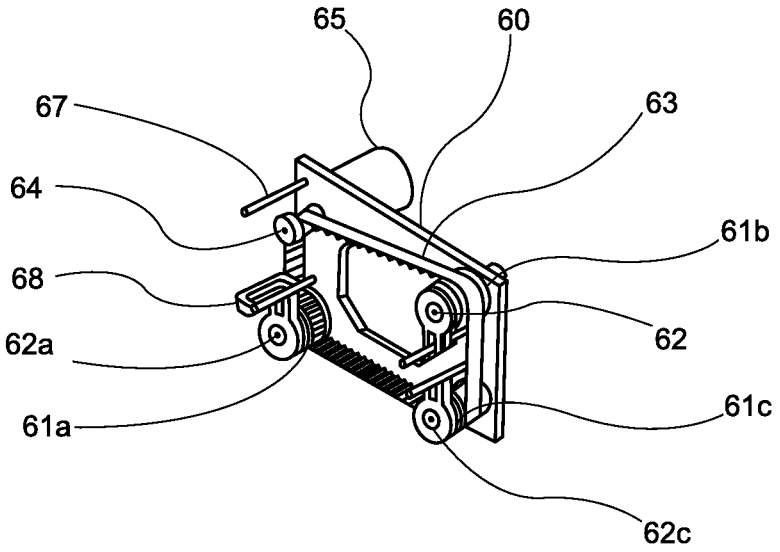
FIGS. 5*a* and 5*b* illustrate the mechanism for engaging and disengaging the contacts, FIG. 5*a* illustrating a perspective view of the arrangement for actuating the insulators and FIG. 5*b* illustrating a cross-sectional view of said mechanism for one of the insulators.
Figure 5:
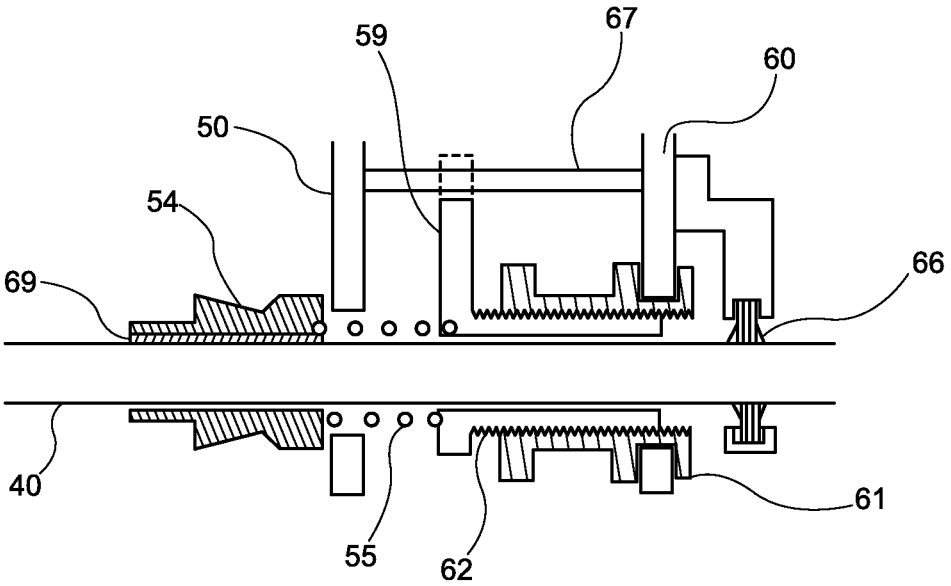

The hotel bus control mechanism is illustrated by FIGS. 5*a* and 5*b*. An insulated flat plate 60 is mounted to the contact frame 50 via a support pillar 67 such that the plate 60 faces and is parallel with the contact frame 50. The flat plate 60 comprises an arrangement for reversibly displacing the insulators of the contact rods 51*a*, 51*b*, 51*c* between the connected and disconnected positions (illustrated in FIGS. 4*a* and 4*b* respectively), the insulators being displaced simultaneously. In effect, this arrangement serves as a three pole contactor that is arranged via a control system to disengage the rod contacts 51*a*, 51 *b*, 51*c* from their respective rods 40*a*, 40*b*, 40*c* during extension and retraction of the extendable tube 10, and to cause the rod contacts 51*a*, 51*b*, 51*c* to engage their respective rods 40*a*, 40*b*, 40*c* when extendable tube 10 has stopped moving, for example when the coupler head 80 has coupled to the coupler head of another coupler.

The control system, which is responsible for controlling (among other things) the extension mechanism 6 and switching of the rod contacts 51*a*, 51*b*, 51*c* will be explained in detail later on.

As illustrated in FIG. 5*a*, the flat plate 60 comprises a contactor motor 65 having a toothed driving pulley 64. The contactor motor 65 may be operated electrically or pneumatically, and comprises a similar locking arrangement to that of the extension motor 24—a spindle of the contactor motor 65 is locked in position and cannot rotate when power is not being applied to the contactor motor i.e. when the contactor motor 65 is not being actuated.

The driving pulley 64 is rotatably coupled to three driven pulleys 61*a*, 61 *b*, 61*c* via contactor belt 63, the driven pulleys being mounted to the flat plate 60 via bearings. In this way, rotation of the contactor motor 65 causes rotation of the driven pulleys 61*a*, 61 *b*, 61*c*.

FIG. 5*b* illustrates a cross-section of a driven pulley 61 and does not show the rod contact 51—the driven pulleys 61*a*, 61*b*, 61*c* are substantially the same in structure and in function. The driven pulley 61 comprises a threaded collar 62 that is mounted radially within the driven pulley 61. The threaded collar 62 engages with threading on an inner surface of the driven pulley 61 such that the driven pulley 61 and the threaded collar 62 are in threaded engagement.

The threaded collar 62 encircles the rod 40 with sufficient clearance such that the collar 62 does not contact the rod 40. The threaded collar 62 protrudes axially (towards the contact frame 50) such that it clears the driven pulley 61, and comprises an elongate portion 59 that is mounted to the support pillar 67 via a slot in the portion 59. Consequently, the threaded collar 62 is rotationally constrained such that rotation of the contactor motor 65, and thus the driven pulley 61, causes axial movement of the threaded collar 62 either towards the contact frame 50 or towards the flat plate 60, depending on the direction of rotation of the contactor motor 65.

Similar to the arrangement for sensing the limit positions of the extendable tube 10, the threaded collar 62*a* comprises a sensor arrangement 68, such as a pair of microswitches, that is arranged to detected limit positions of the threaded collar 62*a* and stop actuation of the contactor motor 65 when detecting these limit positions.

The insulator 54 is mounted to the threaded collar 62 via a biasing means 55, such as a spring, which, along with the shape of the insulator 54, provides the latching function for the two stable positions of the insulator plate 54, i.e. the 'connected' position, which allows the rod contact 51 to connect to the rod 40, and the 'disconnected' position, which disconnects the rod contact 51 from the rod 40. In other words, the latching arrangement of the insulator 54 provides two stable states of connection between the rod contact 51 and the rod 40. FIG. 5*b* illustrates the insulator in the connected position. The insulator 54 is biased against the contact frame 50 latching it in place. When the threaded collar 62 is moved axially towards the contact frame 50, the insulator 54 becomes increasingly biased away from the contact frame 50 under the compression pressure of the biasing means 55 until this pressure overcomes the force of the circlip arrangement which biases the sprung contacts of the rod contact 51 against the rod 40. Consequently, the sprung contacts spring apart, and the insulator 54 moves away from the contact frame 50 until its surfaces engage with the spring contacts, i.e. the 'disconnected' position as illustrated in FIG. 4*b*.

The sprung contacts are thus moved away from the conduction rod 40 to achieve the disconnection as a section of insulator 54 is interposed between the sprung contacts and the conduction rod 40. This discourages any arcing which might otherwise occur under certain conditions. In the reverse operation, when the threaded collar 62 is moved back towards its original position in FIG. 5*b* (i.e. towards the flat plate 60), the biasing means 55 increasingly biases the insulator 54 towards the contact frame 50 until it overcomes the mating force between the mating surfaces of the sprung and the insulator 54. The sprung contacts move further outwards briefly, releasing the insulator to spring back against the contact frame to the 'connected' position illustrated in FIG. 4*a*. As this occurs, the sprung contacts spring back against the conduction rod 40 to resume the 'connected' state of the rod contact 51.

In this way, the contactor motor 65 is arranged to control the movement of the threaded collars 62*a*, 62*b*, 62*c*, and thus the movement of their respective insulators, simultaneously, allowing the rod contacts 51*a*, 51*b*, 51*c* to be switched between engaging and disengaging their respective rods 40*a*, 40*b*, 40*c*.

As the coupler 2 may only be retracted and extended infrequently, with the rail vehicle being part of a train formation with the same adjacent rail vehicle for weeks or months, the conduction rods 40*a*, 40*b*, 40*c* may be subject to oxidation, giving poor electrical contact when the coupler 2 is retracted and then extended such that the rod contacts 51*a*, 51*b*, 51*c* engage different axial positions of the rods 40*a*, 40*b*, 40*c*. Equally, the rail vehicle might not be coupled to any other vehicle for an extended period before it is required to couple to another, potentially giving poor electrical contact due to oxidation or other contaminants on the conduction rod surfaces. This effect is counteracted by the provision of a fibreglass scratch brush arrangement 66 that is mounted to the flat plate 60. The rod 40 passes through the brush arrangement 66. Consequently, axial movement of the tube 10 between the extended and retracted position causes the rods 40*a*, 40*b*, 40*c* and 42 to be scraped by the brush arrangements, helping to remove oxidation on the rods. Since the coupler 2 retracts a significant distance when in the retracted position (i.e. out of use), more than the distance between the rod contact 51*a*, 51*b*, 51*c* and the brush arrangements, when the coupler 2 extends again the section of the rods that will be engaged by the rod contacts 51*a*, 51 *b*, 51*c* is always scraped clean, just before the rod contacts 51*a*, 51*b*, 51*c* engage their respective rods 40*a*, 40*b*, 40*c*. The insulator 54 comprises a soft lining 69, such as polyester film, radially within the insulator 54. The lining 69 comprises a material which not only allows the insulator 54 to slide smoothly relative to the rod 40, but also gives the rod 40 a final wipe clean of any debris the brush arrangement 66 may have created (when scraping the rod 40) immediately before the insulator 54 springs back into the connected position, and the rod contact 51 engages the rod 40. In this way, contact wear due to axial movements of the tube 10 is mitigated and more reliable electrical contact is achieved under conditions of infrequent coupling and uncoupling operations.

During the coupling or uncoupling process between the coupler head 80 and a coupler head of another coupler, the high-power electrical rod contacts 51*a*, 51*b*, 51*c* should be disconnected from their respective rods 40*a*, 40*b*, 40*c* for safety reasons, for example to avoid electrical arcing between the coupler heads.

It is envisaged that all rail vehicles capable of providing hotel power using a coupler of the present invention will be equipped with contactors and/or other arrangements to switch the high-power electrical supply to the coupler 2 on and off, and the control of that switching function will (among other things) be influenced by a coupling event signal. The coupling event signal is arranged to cause the high-power electrical supply of the coupler 2 (via the second set of connections) to be switched off rapidly when the second set of connections of a pair of couplers according to the present invention are about to be coupled. The coupling event signal is also arranged to initiate procedures for reconnecting the rods 40*a*, 40*b*, 40*c* to the hotel bus of the rail vehicle only when all coupling or uncoupling activities are complete. This function may be catered for by other methods on the rail vehicle, but additional protection local to the coupler 2 is advantageous for extra safety, both in the case of faults in the rail vehicle and when the coupler 2 is not in use.

Therefore, in addition to disconnecting the rod contacts 51*a*, 51*b*, 51*c* from the rods 40*a*, 40*b*, 40*c* during extension or retraction of the coupler head 80, the control system also arranges for this disconnection to be maintained during the period after coupling, or before uncoupling, when the contacts in the coupler head 80 are in the process of connecting or disconnecting to another coupler. Only when the coupling process has been confirmed to be fully completed are the rod contacts 51*a*, 51*b*, 51*c* permitted to engage the rods 40*a*, 40*b*, 40*c* again. If the status of the coupler 2 status is 'retracted, out of use' then the control system ensures the rod contacts 51*a*, 51 *b*, 51*c* remain in the disconnected state.

The configuration of the contacts in the coupler head 80 will be described later on.

The hotel bus control mechanism provides a convenient local contactor which can be incorporated in an overload protection circuit to protect the hotel bus wiring. This avoids the necessity of providing that function elsewhere. The sources of hotel power will include their own overload protection arrangements, but with the possibility of multiple power sources in the same train formation, these arrangements are not necessarily a good match to the capabilities of all the hotel bus wiring to which they are connected. It is also possible that the provision of hotel power would be useful for some types of vehicle but the maximum allowable current of the high-power electrical wiring (possibly sufficient for a long luxury tourist passenger train) is far more than the rail vehicles require, and money could be saved by using lower current wiring for the hotel bus connections. Therefore, by having local overload protection arrangements specific to the coupler 2, the current supplies permitted can be matched to the capability of the hotel bus wiring installed locally in the rail vehicle.

In some embodiments, the rods 40*a*, 40*b*, 40*c* may instead be replaced by relatively thick conductive wires/cables where the current requirements of a specific vehicle are not too large. In this case, the wires/cables are arranged to be extended or retracted the required distance, for example using the cables in spiral or folding up configurations, or winding them on sprung reels. Further, the contactor function of the rods and rod contacts is replaced with an alternative suitable arrangement to provide for disconnection of the high power lines during coupling or uncoupling operations and under overload conditions.

Figure 6:
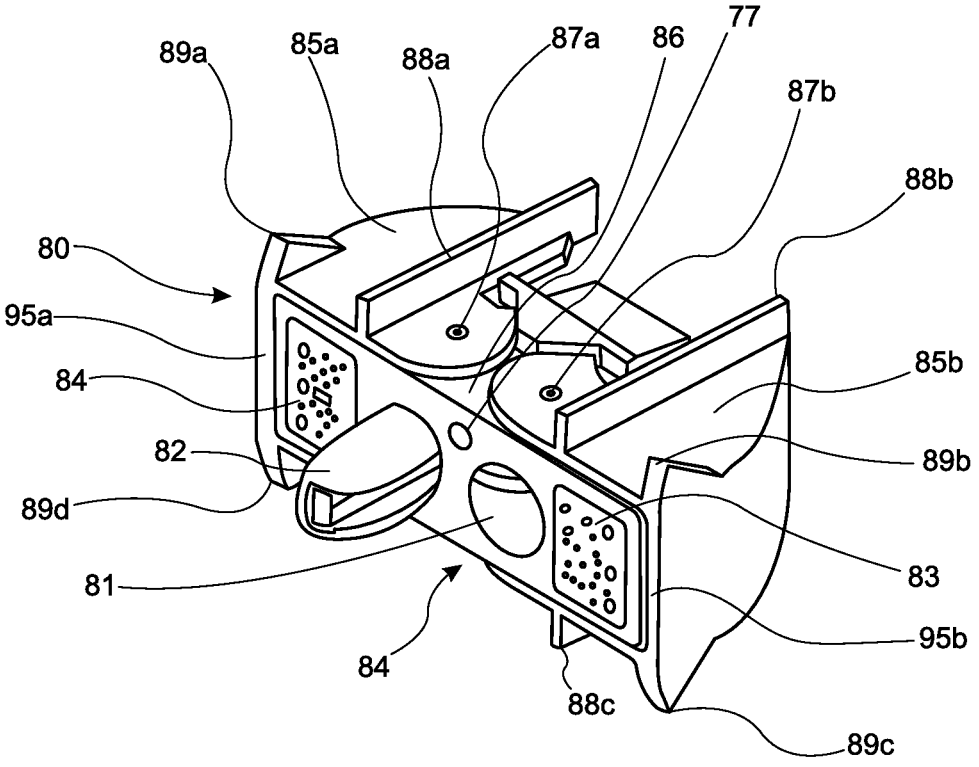
FIGS. 6*a* and 6*b* illustrate a perspective view of the coupler head, showing an open and closed position of the coupler head respectively.
Figure 6:
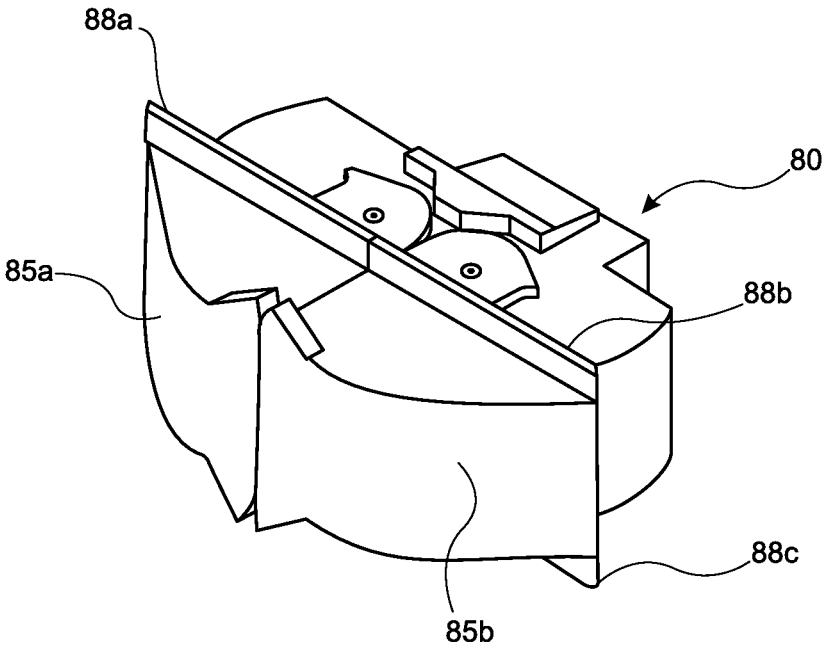

FIGS. 6*a* and 6*b* illustrate the coupler head 80. As described previously, the coupler head 80 is mounted to flange 28*b* of tube 10 via the insulator plate 43*a* (seen in FIG. 3*a*). The coupler head 80 has a substantially rectangular body 86, with an inner face which mounts to the insulator plate 43*a*, and an opposing outer face which is configured as a coupling interface 84 using the Scharfenberg concept.

In this embodiment, the insulator plate 43*a* is a separate member that the coupler head 80 is mounted to, providing a chamber within the coupler head 80 for the terminated connections at the plate 43*a* to be coupled to interface contacts of the coupling interface 84. In other embodiments, the insulator plate 43*a* may be integral with the coupler head 80.

The coupling interface 84 comprises a mechanical coupling arrangement, and interface contacts for the first and second set of connections to couple to. The mechanical coupling arrangement is arranged to mechanically couple the coupler head 80 to the coupler head of another coupler upon (or after) contact between the pair of coupler heads. The interface contacts for the first and second set of connections are arranged to couple these connections to the other coupler after mechanical coupling has occurred between the couplers.

The mechanical coupling arrangement is mounted to a central portion of the coupling interface 84 and comprises a Scharfenberg cup 81 and cone 82, which are arranged to align the coupler head 80 with the cup and cone of another coupler head prior to a link contained within the cone 82 engaging with a Scharfenberg disc inside the cup of the other coupler head, thus mechanically coupling the pair of coupler heads together.

As is typical with a Scharfenberg coupler, arrangements are included for controlling the pneumatic interface connection via an orifice 77 on the coupling interface 84 which is arranged to shut off the pneumatic interface connection when the coupler 2 is not fully and correctly coupled to another coupler The coupler head 80 also includes a pneumatic cylinder (not shown) to initiate mechanical uncoupling from another coupler during the uncoupling process of the coupler 2. This pneumatic cylinder is controlled by a solenoid valve within the coupler head 80 which admits compressed air to the cylinder when instructed to do so by an electrical signal from the coupler control system, as will be described.

The skilled person will understand how the mechanical coupling arrangement, and the interface contacts for the first and second set of connections, are coupled to another coupler according to a Scharfenberg coupler (i.e. via a Scharfenberg cup and cone).

In some embodiments, the coupling interface 84 may be configured using an alternative coupling concept for suitably coupling the coupler head, and the connections of the rail vehicle that are coupled to the interface contacts, to another coupler.

The interface contacts for the electrical (both lower-power and high-power) and optical interface connections are arranged on either side of the mechanical coupling arrangement into two sets of interface contacts: a male set of contacts 83 and a female set of contacts 84. This spatial arrangement of the interface contacts provides a wide but limited height configuration of the coupling interface 84. This arrangement is appropriate for the mounting position of the coupler 2, which is below the rail vehicle close to the railway track with limited vertical height available.

The female contacts 84 are fixed on one side of the coupler head 80, and the male contacts 83 are situated on an opposing side of the coupler head 80 but are able to move relative to the coupler head 80. Subsequent to the mechanical coupling between a pair of coupler heads, the male contacts 83 are arranged to move towards, and to connect to, the female contacts in the other coupler head—this technique is well known, and the skilled person will understand how to implement this feature. All of the male contacts, electrical and optical interface connections, move together under the control of a connection control process as will be described later. The arrangement of male contacts 83 on one side of the coupler head 80 and female contacts 84 on the other side provides the necessary symmetry for connecting with another coupler head facing in the opposite direction. The interface signals from each vehicle connecting to the contacts in the coupler head are duplicated, each signal going to both a male contact and its equivalent female contact in parallel.

This arrangement is advantageous because both groups of contacts 83, 84 are not required to successfully join to their respective contacts in the other coupler for coupling between the respective rail vehicles to be successful. In other words, if any or all of the connections between one of the pairs of contacts fail, for example due to the failure of the male contact moving mechanism in one of the coupler heads, or trapped debris causing poor contact between a specific pair of contacts, the other correctly joined pair of groups of contacts is sufficient to sustain the coupling of the connections of the pair of rail vehicles together. In this way, the interface contacts of the coupling interface 84 are more reliable relative to an arrangement providing only one set of contacts.

In some embodiments, less preferably, there may be more or less than two sets of interface contacts.

The division of the electrical interface of the coupler 80 into two sets of interface contacts (i.e. the male and female contacts) is advantageous, as it limits the total current deliverable by a single electrical interface contact, dividing the total current between the male and the female electrical contacts, which in this embodiment would be 100 A per electrical contact. In this way, should one of the pair of high-power electrical interface contacts fail to connect properly (for example due to failure of the moving mechanism of the male contacts 83), then the hotel bus current capacity is halved. The control system is able to detect this situation, such that, in use, only allowable currents (for both the male and female electrical contacts) for the wiring installed are permitted—the hotel bus control mechanism is arranged to switch off the hotel bus connection when current overloads are detected. For the great majority of situations, half of the total maximum current deliverable by the hotel bus, i.e. provided by one of the pair of electrical contacts, will provide sufficient current capacity and normal operation of the rail vehicle can continue. The control system flags this fault such that remedial action can be taken later. These arrangements supplement the local overload protection capacity of the coupler 2, further protecting the hotel bus wiring.

Figure 7:
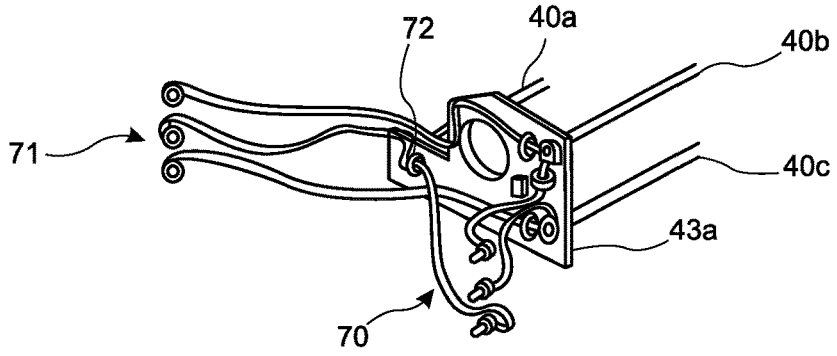
FIGS. 7*a* and 7*b* illustrate the termination arrangement of the conductive rods, FIG. 7*a* illustrating a perspective view of the male and female electrical pairings of each rod, and FIG. 7*b* illustrating this arrangement, as well as the overload protection arrangement of the rods, schematically.
Figure 7:
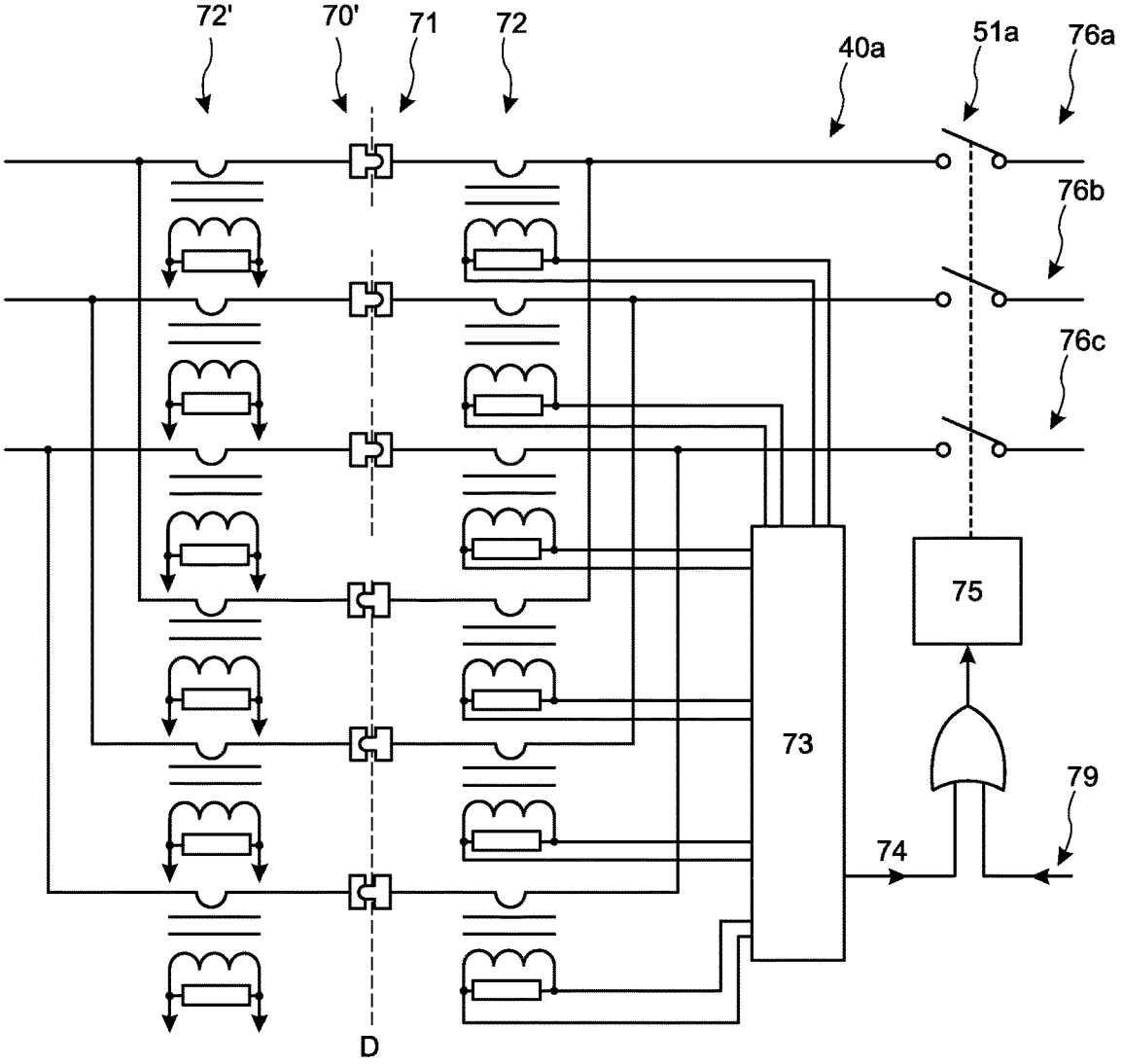

The termination arrangement of the second set of connections to split the current capacity of the hotel bus between their respective electrical interface contacts in the male and female contacts 83, 84 is illustrated in FIG. 7*a*.

Outer ends of the rods 40*a*, 40*b*, 40*c* protrude beyond an outer face of the insulator plate 43*a* (which faces the coupling interface 84), and are housed within the coupler head 80, along with the termination box 45*a*. The end of each rod 40*b*, 40*c* is coupled to the electrical interface contacts in the coupling interface 84 via high-power conductive cables.

More specifically, in this embodiment, the end of each rod 40*a*, 40*b*, 40*c* comprises two pairs of high-power conductive cables (for example 50A per cable), one of which couples to a male electrical contact 70 that is part of the male set of contacts 83, and the other of which couples to a female electrical contact 71 that is part of the female set of contacts 84. In this way, each electrical contact 70, 71 provides half of the total current capacity of the hotel bus, i.e. each contact 70, 71 provides 100 A. In some embodiments, the pair of high-power conductive cables may be replaced with more or less than two conductive cables.

Each of the pairs of high-power conductive cables are threaded through the centre hole of a current transformer 72, which is mounted to or near the end of each respective rod. The high-power conductive cables therefore constitute the primary windings of the transformer 72, while the secondary windings are formed via turns of wire that are wound upon a laminated core of the current transformer 72. Each rod 40*a*, 40*b*, 40*c* therefore connects to a pair of current transformers, one for each pair of conductive cables.

In this embodiment, the upper rod 40*b* will form the grounded centre tap of the hotel bus supply, while the other rods 40*a*, 40*c* will each provide a 'live' 1000V supply voltage. The connection points in the electrical contacts 70, 71 for each rod providing the live voltage supply is reversed: each conduction rod is joined to a middle contact on its side and a lower contact on the opposite side. This ensures that when two rail vehicles are coupled together, the conduction rods for each live connection are on the same side of the train rather than opposing side, to facilitate testing of these connections.

The circuit schematic for the interconnection between the high-power electrical male and female contacts 70, 71 of a pair of coupling interfaces according to the present invention is illustrated in FIG. 7*b*, the schematic for the coupler 2 being on the right of the dotted line D, and the schematic of the other coupler being on the left-hand side of the dotted line D. The overload protection arrangement for the coupler 2 is also illustrated, and for clarity, only the current transformer arrangement of the other coupler is illustrated. Both of these circuit arrangements are functionally identical, each coupler being equipped with substantially the same circuit configuration.

The hotel bus from the rail vehicle that is coupled to the rods via the rod contacts comprises hotel bus lines 76*a*, 76*b*, 76*c*, one for each respective rod—these are schematically illustrated in FIG. 7*b*. Current may flow through the lines 76*a*, 76*b*, 76*c* in either direction, depending on the positions of current sources and loads in the train formation. Current passing through the current transformers induces a voltage in the secondary windings of the transformer. This voltage is dropped across a load resistor of the transformer, which is then measured by a current sensing arrangement 73.

The length of wiring between a conduction rod and its male electrical contact is not necessarily the same as the length to its female electrical contact. However, when a pair of couplers are coupled together, the combined length between the two interconnected conduction rods always splits between shorter and longer cables in series, in parallel with longer and shorter cables in series. Consequently, provided both of the electrical contact pairs have connected without fault, current will divide equally between both conduction paths.

The current sensing arrangement 73 measures the voltages from the current transformers using rectifiers and threshold detecting arrangements, and if any voltage exceeds the equivalent of the maximum current capacity through any conduction path, or the combined total from the two conduction paths of a hotel bus line exceeds the capacity of the wiring installed in that particular rail vehicle, a sensing arrangement output signal 74 is generated, requesting that the hotel bus lines 76*a*, 76*b*, 76*c* be disconnected from the rods. This signal 74 passes via an OR gate function to a contactor control circuit 75, which is arranged to cause the hotel bus to be disconnected by operating the contactor motor 65 as described earlier.

A second signal 79 coming from the control system of the coupler 2 is connected to the OR gate function also, which indicates when some coupling or uncoupling activity is in progress, or the current status is 'uncoupled', to ensure the hotel bus is again disconnected from the rods. The OR gate function is provided by the control system, either via software or as a hardware component. In this way, the hotel bus can be disconnected from the rods 40*a*, 40*b*, 40*c* during a current overload situation and/or coupling or uncoupling processes.

In some embodiments, the output signal 74 is also arranged to indicate to the control system that an overload has occurred, which can be reset once the fault has been resolved.

These overload protection arrangements in the coupler 2 only accommodate the high currents of the hotel bus lines themselves passing through the rail vehicle from one end to the other. All lower current circuits within the rail vehicle which are supplied from the hotel bus will have their own dedicated overload protection functions, such circuit breakers or fuses, as appropriate.

In some embodiments, there may be no current sensing arrangement 73 and/or current transformers, and thus no resulting overload protection function.

In other embodiments, the coupler 2 may not comprise a second set of connections, i.e. high-power electrical coupling arrangements for a hotel bus of a rail vehicle. This is because some rail vehicles (for example simple freight wagons carrying minerals) may not require the high-power electrical supply of the hotel bus, and may never be used in train formations where they are required to distribute hotel power between a source (such as a locomotive) and other rail vehicles needing such power either. In this case, as these rail vehicles do not require hotel bus wiring, the coupler 2 does not comprise all the components associated with the coupling of the second set of connections as described above (i.e. it does not have the conduction rods and insulators, contact frame and rod contacts, current transformers and high-power cables, the flat plate with the contactor motor and mechanism, etc). This provides for a cheaper coupler suitable for rail vehicles that do not have hotel bus wiring. All of the other components of the coupler 2 are the same as described above (i.e. the extending mechanism, the coupler head, the first set of connections arrangement, etc.). This allows a cost-effective coupler 2 to be provided with a universal basic design that is suitable for most rail vehicles.

Finally, the terminated low-power electrical and optical connections from the termination box 45*a* are coupled to their respective interface contacts between the male and female contacts 83, 84 (not shown). The terminated pneumatic connection is coupled to a pneumatic link arrangement at the orifice 77 which comprises an isolation valve that opens only when a pair of couplers have joined correctly. A branch from this compressed air connection, before the isolation valve, also leads to the solenoid valve, which is normally closed but admits air to the uncoupling cylinder when the uncoupling process is being undertaken.

A protective covering arrangement of the coupler head 80 will now be described. Returning to FIGS. 6*a* and 6*b*, the covering arrangement comprises a first shield 85*a* and a second shield 85*b* that are arcuate in shape. The shields 85*a*, 85*b* are pivotally mounted to the body 86 of the coupler head 80 via pivots 87*a*, 87*b* on both a top surface and bottom surface (not shown) of the coupler head 80. In this way, the shields 85*a*, 85*b* are able to rotate substantially 90 degrees, between an open position (illustrated in FIG. 6*a*) and a closed position (illustrated in FIG. 6*b*).

In the closed position, outer edges 95*a*, 95*b* of the shields 85*a*, 85*b* contact one another such that the shields 85*a*, 85*b* form a substantially semi-circular housing which covers and contains the coupling interface 84 within. In this way, the coupling interface 84 is protected from the ambient environment, making the coupler 2 robust and able to withstand harsh environmental conditions such as might be encountered at the front end of a train speeding into a blizzard or a sandstorm. The shields 85*a*, 85*b* are in the closed position when the extendable tube 10 is in the retracted position, as will be described later on.

In the open position, the shields 85*a*, 85*b* are substantially parallel relative to one another, with the outer edges 95*a*, 95*b* being substantially flush with the coupling interface 84, exposing the coupling interface 84. In this way, the coupling interface 84 is able to couple to the coupling interface of another coupler during the coupling process, as the shields 85*a*, 85*b* do not physically obstruct the coupling interface 84. The shields 85*a*, 85*b* are in the open position when the coupling interface 84 has coupled to another coupler. In this coupled position, the outer edges 95*a*, 95*b* rest against the corresponding edges of the other coupler.

The shields 85*a*, 85*b* comprise longitudinal protrusions 88*a*, 88*b*, 88*c* (the fourth protrusion is not shown) that run along the length of the shields, both on the top and bottom surface of the shields. In the closed position, these protrusions form longitudinal flanges that are substantially parallel with the coupling interface 84. When the coupler head 80 is retracted to within the housing 90, the flanges are arranged to cover upper and lower clearances between the coupler head 80 and the housing 90, clearances which are required to allow the extension mechanism 6 to pivot vertically when in use.

As the coupler head 80 is considerably wider than the extension mechanism 6, corresponding flanges on the sides of the coupler head 80 are not required: when retracted, the coupler head 80 is received by the housing 90 and held securely by a wedge-type arrangement (explained further below) to hold the coupler head 80 securely such that it does not rattle when subject to vibrations. In the retracted state, the coupler head 80 is thus well sealed against hazards such as snow, which tends to penetrate the coupling mechanisms in conventional coupler designs, which reduces the reliability of these couplers.

Figure 8:
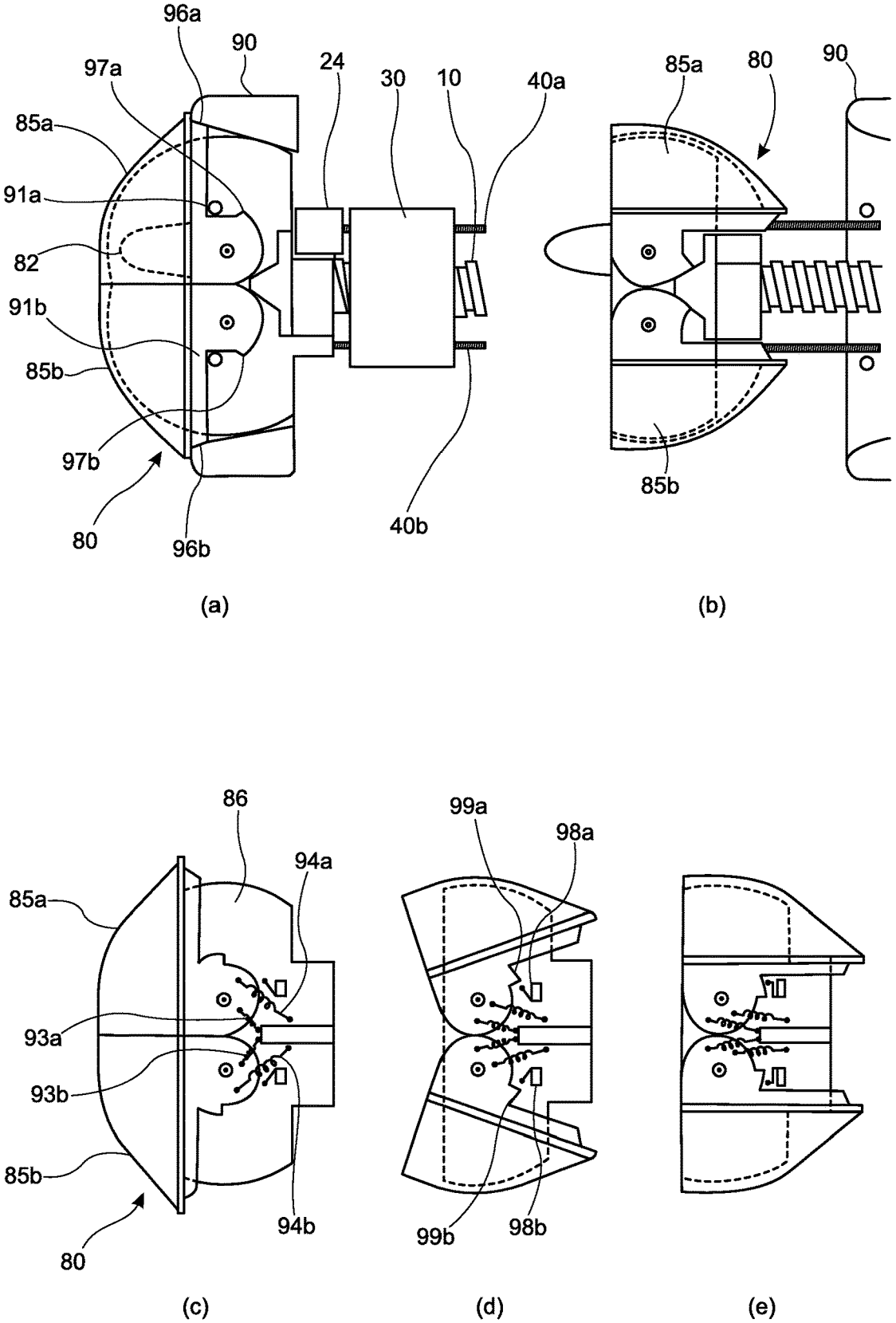
FIGS. 8*a*, 8*b*, 8*c*, 8*d*, and 8*e* illustrate a plan view of the shields of the coupler head, in particular

FIGS. 8*a* and 8*b* illustrate a plan view of the coupler head 80, and FIGS. 8*c* to 8*e* illustrate a bottom view of the coupler 80. As illustrated in FIG. 8*d*, the shields 85*a*, 85*b* are arranged to held in a neutral position between the open position (illustrated in FIG. 8*c*) and the closed position (illustrated in FIG. 8*e*), about 70 degrees from the closed position of the shields 85*a*, 85*b* (i.e. the outer edges 95*a*, 95*b* are 70 degrees relative to their position in the closed position).

In this embodiment, this holding arrangement of the shields 85*a*, 85*b* is achieved via respective springs 94*a*, 94*b*, which connect between the shields 85*a*, 85*b* and a bottom side of the body 86 of the coupler head 80. In other embodiments, the holding arrangement may be achieved using a suitable arrangement other than springs.

Consequently, the outer edges 95*a*, 95*b* protrude axially beyond the coupling interface 84 (i.e. towards the other coupler). In this way, the outer edges 95*a*, 95*b* contact the outer edges of another coupler as the pair of couplers are drawn closer together. The shape of the shields 85*a*, 85*b*, along with their respective springing arrangements and projections, allow the shields 85*a*, 85*b* to slide freely against shields of another coupler in any direction to accommodate initial misalignments there may be between the coupler heads during the coupling process.

Dampers 93*a*, 93*b*, which connect between the shields 85*a*, 85*b* and the body 86 of the coupler head 80, act as shock absorbers. If a pair of opposing shields make contact before the other pair of shields, due to misalignment, the springs 94*a*, 94*b* and the dampers 93*a*, 93*b* encourage the pair of coupler heads to pivot to face each other. In other words, the springing arrangements of the shields encourage the coupler heads to suitably orientate themselves with respect to each other as the coupler heads are gradually drawn closer together (i.e. via the extension mechanisms), before the cup and cones of the coupler heads come into contact with one another to complete the alignment process.

Each outer edge 95*a*, 95*b* comprises a pair of opposing projections 89*a*, 89*b*, 89*c*, 89*d* which prevent the outer edges 95*a*, 95*b* from inadvertently latching inside the edge of the other coupler when a pair of couplers first contact one another. This might otherwise occur during the coupling process if there are significant initial misalignments between the coupler heads in both horizontal and vertical planes, as the shields 85*a*, 85*b* are held in between the open and closed position, at about 70 degrees.

As the coupler heads are drawn closer together (i.e. via their respective extension mechanisms), the outer edges 95*a*, 95*b* of the shields 85*a*, 85*b* are gradually displaced axially towards the coupling interface 84 until they become substantially parallel with the coupling interface 84 as illustrated in FIG. 8*e*—the outer edges 95*a*, 95*b* are biased against the outer edges of the other shields of the other coupler. In other words, the shields 85*a*, 85*b* move from the neutral position to the open position. During this transition, the Scharfenberg cup 81 and cone 82 will have brought the coupler heads into the correct alignment, such that the outer edges 95*a*, 95*b* of the shields 85, 85*b* form a seal with the edges of the corresponding shields of the other coupler. As a result, the coupler heads are well protected from harsh ambient environments.

In the case snow settles on the shields 85*a*, 85*b* when in the closed position, the snow will likely be mostly undisturbed when the shields 85*a*, 85*b* rotate, or will be shaken off when the pairs of shields first contact one another during the coupling process. This reduces the risk of unreliable operation of the coupler 2 due to any snow penetrating critical parts of the coupling mechanisms, as these are only accessible from the outside environment for the short period, such as a few seconds, between the shields 85*a*, 85*b* being fully closed and fully open.

With the coupler heads being in contact and in the correct alignment, the cup and cones of the coupler heads are arranged to mechanically engage one another, mechanically coupling the coupler heads together.

The shields 85*a*, 85*b* are arranged to move from the neutral position in FIG. 8*d* to the closed position when the coupler head 80 is retracted to within the housing 90. This is achieved via an interaction between parts of the housing 90 and the coupler head 80 which biases the outer edges 95*a*, 95*b* of the shields against one another, which is illustrated in FIG. 8*a*.

The housing 90 comprises two pegs 91*a*, 91*b* that are arranged to assist biasing the shields 85*a*, 85*b* into the closed position. The pegs 91*a*, 91*b* are positioned on the housing 90 to receive respective slopes 96*a*, 96*b* on inner edges of the shields 85*a*, 85*b*, which, as the coupler head 80 is being retracted to within the housing 90, cause the shields 85*a*, 85*b* to rotate into the closed position. As the shields assume the closed position, the slopes 96*a*, 96*b* are received by corresponding slopes in the housing 90, which engage protruding portions of the flanges, helping to retain the shields 85*a*, 85*b* in the closed position. This wedging action is facilitated by the use of a slightly resilient material, such as nylon, on the outer edges 95*a*, 95*b*, providing a good seal against the environment when the shields 85*a*, 85*b* are closed, allowing easy sliding when engaging with another the shield of another coupler when coupling, and having low adhesive properties to limit the risk of the shields 85*a*, 85*b* sticking together due to frost in cold conditions. In this way, the coupling interface 84 can be covered and protected when the coupler 2 is out of use in the retracted position.

In this embodiment, the rear casing of the coupler head 80 is asymmetrical: a section is cut away at the top half of one side to give clearance for the extension motor 24 when the coupler head 80 is in the retracted position. Less space is required inside the coupler head 80 in this area, as this side accommodates the static female contacts 84 which do not move therefore do not require a movement mechanism. The male contact 83 side of the coupler head 80 has greater depth in the top half, to provide space for the mechanism which moves the male contacts 83. The dotted lines in FIGS. 8*a* and 8*b* illustrates how inside surfaces of the shields 85*a*, 85*b* are arcuate, providing sufficient clearance for the conventional Scharfenberg cup 81 and cone 82.

As the coupler head 80 is extended from the retracted position, within the housing 90, such that it clears the housing 90, the springs 94*a*, 94*b* draw the shields 85*a*, 85*b* open to the neutral position (illustrated in FIG. 8*d*) as the shields are no longer being biased against one another by the pegs 91*a*, 91 *b* and slopes of the housing 90. The dampers 93*a*, 93*b* limit oscillations when the shields 85*a*, 85*b* are being sprung open from the closed position to the neutral position.

FIG. 8*b* illustrates the coupler head 80 being extended from the retracted position, within the housing 90, to a minimum coupling distance of the coupler 2. In this Figure, the coupler head 80 is coupled to another coupler, but this is not shown for clarity purposes. This minimum coupling distance is necessary to permit sideways pivoting movement of the coupler 2 when the rail vehicles are traversing very sharp curves in the railway track. Much longer extensions than that illustrated in FIG. 8*b* will be typical.

When the coupler head 80 is extended from the retracted 'out of use' position, the shields 85*a*, 85*b* will spring open as soon as their movement away from the housing 90 permits. However, in some cases, the shields 85*a*, 85*b* may be frozen together and refuse to open in icy conditions, despite the nylon edges. To address this, the shields 85*a*, 85*b* comprise sloped rims 97*a*, 97*b*, proximate to the pivots 87*a*, 87*b*, that are configured to contact the pegs 91*a*, 91*b* when the shields 85*a*, 85*b* are extended from the retracted position. The slope on the rims 97*a*, 97*b* act in combination with the force exerted by the extension mechanism to prise the shields 85*a*, 85*b* apart: once they are unstuck, the springs 94*a*, 94*b* take over and the shields 85*a*, 85*b* are drawn open as normal.

The shields 85*a*, 85*b* not only provide environmental protection for the coupler head 80, but also provide a function to detect whether another coupler is in the immediate vicinity or not. Two microswitches 98*a*, 98*b* are mounted to the underside of the coupler head 80 (illustrated in FIG. 8*d*). The switches 98*a*, 98*b* comprise rollers which are depressed by extended edges 99*a*, 99*b* of the shields 85*a*, 85*b* when the shields 85*a*, 85*b* rotate beyond the neutral position, towards the open position. This rotation only occurs when the coupler head of another coupler is in close proximity and in contact with the coupler head 80. The microswitches 98*a*, 98*b* are able detect this scenario via the depression of their respective rollers due to contact with the extended edges 99*a*, 99*b*. The microswitches 98*a*, 98*b*, springs 94*a*, 94*b* and dampers 93*a*, 93*b* are all protected from the environment via a cover (not shown in FIGS. 8*c* to 8*e*) that is mounted to the bottom side of the body 86 of the coupler head 80 such that it houses the microswitches 98*a*, 98*b*, springs 94*a*, 94*b* and dampers 93*a*, 93*b*. This cover does not interfere with movement of the coupler 80 to within and without the housing 90. In some embodiments, the microswitches 98*a*, 98*b* may be replaced by other equivalent sensors.

Output signals from the microswitches 98*a*, 98*b* indicate when another coupler is in close proximity/contact with the coupler head 80. These output signals can be utilised by the control system of the coupler 2 to control the speed of the extension (or retraction) of the coupler head 80 when a pair of coupler heads are in contact with one another. In some embodiments, the switches 98*a*, 98*b* are connected via an OR function such that when either (or both) are active an output signal indicating another coupler is near is generated.

Since the movement of the coupler 2 is provided with a degree of damping, coupler misalignments cannot be corrected instantly, but take time for the springs 94*a*, 94*b*, and other forces, to overcome the damping effect. Therefore, the final stages of the coupling process are performed relatively slowly, which is desirable to minimise any transient movement in the rail vehicles when coupling takes place. In order to minimise the total time required for coupling, to provide quick train reconfiguration, the initial extension of the coupler 2 from the retracted position is performed rapidly, i.e. when a pair of coupler heads are apart. When the coupler heads contact one another, the control system detects this, via the output signal from the microswitches 98*a*, 98*b*, and is arranged to slow down the extension motor 24 considerably such that the final stages of coupling are performed gently. Finally, when the coupling has been completed and the Scharfenberg mechanism (i.e. cup 81 and cone 82) of the coupler head 80 has successfully locked the pair of coupler heads, and thus the two rail vehicles, together, a sensor in that mechanism generates a signal to the control system to stop the extension motor 24. The combined coupling process causes vehicles to join almost imperceptibly, in contrast to the current methods which cause inevitable jolting to some degree.

The same speed control technique is also used when uncoupling, but in reverse. Initially, the retraction of the coupler 2 is slow immediately after the Scharfenberg discs have been rotated for uncoupling and the engaged coupler heads begin to disengage. The control system detects once the coupler heads have separated and the shields 85*a*, 85*b* have sprung back to their neutral positions, via the microswitches 98*a*, 98*b*. Once this occurs, the control system is arranged to speed up the extension motor 24, causing a rapid retraction of the coupler 2 to the retracted, 'out of use' position within the housing 90. This arrangement results in a low disturbance but rapid uncoupling process, contributing to a safe, timely and efficient service to customers.

Accordingly, the absence of an output signal from either of the microswitches 98*a*, 98*b* indicates when a coupled coupler has physically disengaged from the coupler head 80, i.e. once the microswitches 98*a*, 98*b* are no longer being triggered from contact with the extended edges 99*a*, 99*b*. This might not occur when expected in some operating circumstances.

If uncoupling takes place when both vehicles are stopped and all brakes are fully applied, then the separation of the coupler heads depends only on the retraction process of both couplers' extension mechanisms, a process well under control and taking a known time. However, uncoupling is also possible when the vehicles are moving, a common example being in 'hump' shunting where rail vehicles are uncoupled while being propelled up a slope, and they disengage from the propelling rail vehicle only after the summit is reached and a now descending gradient causes them to accelerate away from the rail vehicles causing propulsion. In this situation, there may be a considerable delay between the uncoupling action and the actual separation of the two rail vehicles.

In this case, the coupler 2 cannot be retracted to the 'out of use' position in the usual relatively short time, as its continued extension (at least to some extent) is required to cause propulsion. Here, retraction of the coupler 2 is not required to be relatively quick, as it will be some time before the coupler 2 can be brought into use to connect to another rail vehicle. This type of operation is detected using a simple timer arrangement in the control system of the coupler 2. The timer is set to give an output after a delay from the time the uncoupling action of the Scharfenberg discs has taken place. This delay is slightly longer than the typical time taken for the shields 85*a*, 85*b* to spring back to their neutral positions, when all rail vehicles are stopped. If output signals from the microswitches 98*a*, 98*b* disappear (or are drawn low etc depending on the logic arrangement used) as expected, the retraction process continues as normal. If output signals from microswitches 98*a*, 98*b* have not disappeared (or are still high etc) by that time, the coupler heads must still be in contact to some extent and the retraction process is stopped immediately. If such an event has occurred, the control system is arranged to register this event, and will not resume the retraction process until the output signals from both of the microswitches 98*a*, 98*b* have disappeared consistently for a longer period of time, as determined by a second timer. This second time delay provides protection against the small possibility that a rail vehicle being propelled might separate temporarily from the propelling rail vehicle, but re-join again due to changes in gradient, acceleration or deceleration for some reason, etc. In this way, retraction of the couplers only occurs when the propelled rail vehicle is no longer transiently contacting the propelling rail vehicle, and has ceased to do so for a sufficiently long period that a later return of the propelled and propelling vehicles into contact is extremely unlikely.

A similar situation might occur when a rail vehicle (or group of rail vehicles) is being detached from the front of a moving main train formation on a main railway line, and the rail vehicle accelerates away from the main train using its own traction capability, rather than gravity. The timer delay arrangement also accommodates the situation that uncoupling might occur some time before the actual departure of the detached rail vehicle(s). Further, the timer delay arrangement is also appropriate for uncoupling a rail vehicle or group from the rear of a train formation at speed, the same technique as was once used for the 'slip coach' detached from the rear of an express passenger train to give a service to an intermediate station. More modern detached vehicles may have their own traction capability rather than just relying on the acquired momentum, so they would not necessarily separate from the main train as soon as they are uncoupled, and the timer delay arrangement accommodates this eventuality.

In some cases, moving groups of rail vehicles may be coupled together, rather than having to be stopped before coupling can take place. The extension process of the coupler 2 would allow approaching rail vehicles coming together slowly with a small difference in their speeds to reach the optimum coupling distance, and subsequently be coupled together gently with minimum disturbance. Such operating methods are envisaged to transform the flexibility and level of service provided by the railway in future, particularly in the operation of mixed freight trains, and would have benefits for the energy efficiency of these vehicles also.

The shields 85*a*, 85*b* are therefore arranged to indicate both when another coupler is in close proximity, and when a coupled coupler has disengaged from the coupler head 80.

Figure 9:
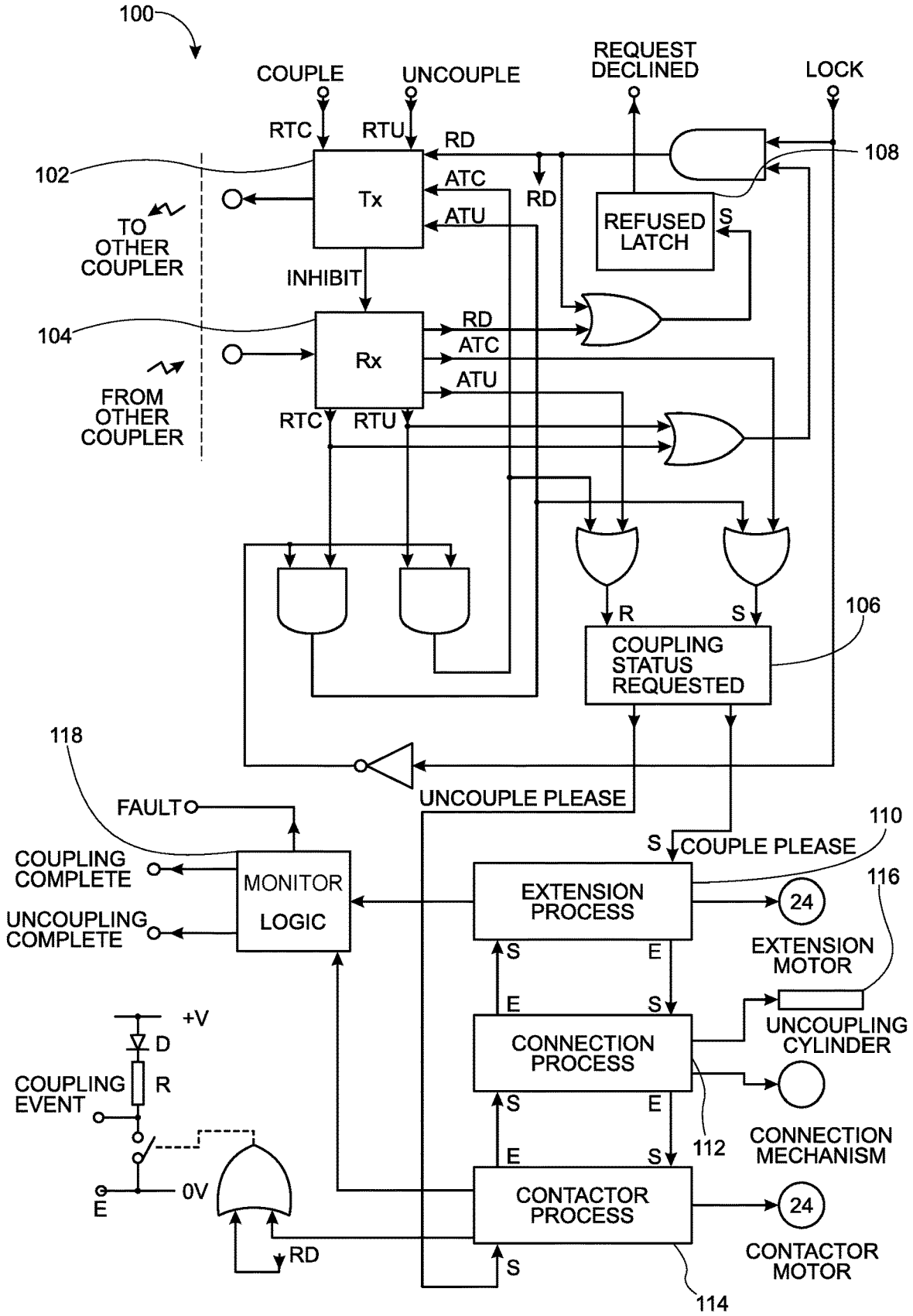
FIG. 9 illustrates a schematic overview of the control system of the coupler.

The control system of the coupler 2 will now be described. An overview of the control system 100 is illustrated in FIG. 9. The control system 100 is arranged to control and operate various components and functions of the coupler 2. This may be achieved, for example, via a controller in electronic communication with nearby electronic modules that are distributed throughout the coupler 2 proximate to the components they are controlling and/or sensing, as the skilled person will understand.

In particular, the control system 100 is arranged to control actuation of the extension motor 24, and thus the extension mechanism 6. In this way, the control system 100 can control extension and retraction of the extendable tube 10 between the extended position and the retracted position.

The control system 100 is also arranged to control and to monitor (amongst other things) the switching of the rod contacts 51*a*, 51*b*, 51*c* to control the hotel bus power supply, the coupling process of the male and female contacts 83, 84 to another coupler, and the mechanical coupling process of the Scharfernberg cup 81 and cone 82 arrangement to another coupler.

Further, the control system 100 is also arranged to communicate with the control system of another coupler to control the coupling or uncoupling process between a pair of couplers such that it can be synchronised accordingly, as is described further below.

To allow external control of some of the functions of the coupler 2, the control system 100 is also arranged to receive a number of inputs from a train management system, either locally to the rail vehicle the coupler 2 is mounted to, or preferably, by a comprehensive vehicle identification and communication system operating via a train information bus which allows any train management computer anywhere in a coupled train formation to access the characteristics, functions and controls of any rail vehicle, and thus any of the mounted couplers, within it. In some embodiments, the control system 100 may instead, or in addition to, receive wireless inputs either directly or indirectly via a separate vehicle controller to allow the coupler 2, and the coupling and uncoupling processes between a pair of rail vehicles, to be controlled remotely, for example from the control centre of a marshalling yard, rather than from within the vehicle itself or from other vehicles coupled to it.

In this embodiment, there are three inputs to the control system 100: a request to couple (RTC), a request to uncouple (RTU), and a command to lock which, if set, prevents the coupler 2 (or rail vehicle) from responding to requests to couple or uncouple from another coupler (or rail vehicle). In other embodiments, there may be less or more than these commands depending on the functionality desired of the coupler 2 during manufacture—these functions may also be added or removed after manufacture via software/firmware modifications to the control system of the coupler 2.

Outputs from the control system 100, in addition to activating the various functions as described earlier, comprise status flags to confirm that coupling or uncoupling have been completed successfully, a fault flag to indicate some problem occurring, and the coupling event signal described earlier, which is linked throughout the train formation and is activated whenever there is some activity relating to an imminent potential change in train formation.

As noted earlier, the coupler 2 comprises a wireless communication system that is arranged to transfer commands between the control systems of rail vehicles before they have coupled together. This can be achieved, for example, using radio, ultrasonic, infra-red or other wireless communication methods. In other words, the transmitter 'Tx' and receiver 'Rx' of the communication system, and the frequency, modulation method and coding systems of the communication system are arranged such that the coupler 2 is able to wirelessly communicate with another coupler.

The wireless communication system utilises short-range communication methods, and in this embodiment, is arranged to transmit and/or receive a small number of different commands, preferably five. In other embodiments, the wireless communication system may be arranged to transmit and/or receive more or less than five commands.

The receiving part of the communication system is arranged to be constantly active to receive commands from another coupler of another rail vehicle, including when no source of power is provided to the coupler 2 and/or corresponding rail vehicle. In this case, the control system 100 is arranged to enter a standby mode such that the overall power consumption of the control system 100 is relatively very low, allowing a small backup battery to sufficiently provide this power.

In this embodiment, power for operating the coupler 2, and for recharging the backup battery, is provided from the 230V DC supply used to power the ECP (Electronically Controlled Pneumatic) braking system, as this is linked through all rail vehicles whether they have hotel bus power connections or not. In other embodiments, there may other arrangements for providing power to the coupler 2, and the backup battery, from other connections of the rail vehicle.

In some embodiments, a small solar panel or other energy harvesting device on the rail vehicle is arranged to provide power to the backup battery such that a rail vehicle comprising the coupler 2 can be left unused in a siding indefinitely, but the coupler 2 will still respond to a train formation coming to retrieve it after a long period of time using another coupler of the present invention.

To avoid interference between the transmitter and receiver of the same communication system, for example by the transmitted signal being reflected off objects towards the receiver, the transmitter is arranged to provide an 'inhibit' signal to the receiver to prevent the receiver from responding as long as the transmitter is active. In this way, the receiver only responds to the transmitter in the other coupler of the other vehicle, not the transmitter in its own coupler 2.

In this embodiment, the commands that are transmitted and received by the communication system of the coupler 2 to another coupler comprise: the request to couple (RTC), the request to uncouple (RTU), an agreement to couple (ATC), an agreement to uncouple (ATU), and a request decline (RD). These commands are arranged to control the coupling and uncoupling process between a pair of couplers according to the present invention.

For example, as illustrated in FIG. 9, when the train management system of a first rail vehicle comprising the coupler 2 sends an RTC command to the control system 100, the transmitter 102 is arranged to transmit the RTC to another coupler of a second rail vehicle. The received RTC is decoded by the receiver 104 of the other coupler and, if the 'lock' function is not activated (i.e. via the lock command), the receiver 104 is arranged to generate an agreement to couple (ATC) command which causes the 'coupling status requested' latch 106 to be set to the 'couple please' state in the second rail vehicle. As this process occurs, the transmitter 102 of the second rail vehicle is arranged to return an ATC to the first rail vehicle. After the ATC has been decoded in the receiver 104 of the first vehicle, the receiver 104 is arranged to set the 'coupling status requested' latch 106 to the 'couple please' state in the first vehicle also.

If, the 'lock' function is activated in the second vehicle, reception of the RTC in the receiver 104 causes no change in the 'coupling status requested' latch 106. Instead, the transmitter 102 is arranged to transmit a RD back to the first rail vehicle. It also sets a 'refused' latch 108 in the second rail vehicle, which can be read by that train formation's train management system to indicate that a request to change the coupling status has been made by another rail vehicle but declined. As a result of receiving the RD message back in the first rail vehicle, the 'coupling status requested' latch 106 in the first rail vehicle does not change its state either, but the 'refused' latch 108 is set instead to indicate that a request was made but not acted upon.

A similar sequence of events after reception of a RTU results in the 'coupling status requested' latch 106 of both rail vehicles being reset to the 'uncouple please' state if the 'lock' function is not active, both 'coupling status requested' latches remaining unchanged, and the 'refused' latches being set if the 'lock' function has been activated.

Apart from special test modes for maintenance purposes, the coupling status in a rail vehicle cannot be changed from that rail vehicle independently. The interconnected system checks first that the coupler of the second rail vehicle has agreed to take the same action before coupling or uncoupling can proceed, both control systems of the couplers taking the same actions at approximately the same times.

The 'lock' function is useful for several purposes. When a train formation has been completed, it may be desired to lock all couplers in their current state, for additional security against picking up false commands due to mistaken actions by staff, software errors, or stray communications from nearby trains, etc. Further, there might be discrepancies in instructions to staff leading to confusion about the correct courses of action. The driver of a train arriving at a station scheduled to couple to another train might not know it has developed a fault or the wrong train is in position for some other reason, for example. The lock function allows local staff to prevent the arriving train from coupling on, its driver being alerted to the refusal of the coupling attempt by the control system and thus prompted to confer with local staff about what to do next. The locks of adjacent couplers may be set in the same or different states as required. If the lock in a first rail vehicle is not activated but the lock in a second rail vehicle is activated, then the first rail vehicle may not initiate coupling to the second rail vehicle, but the second rail vehicle can initiate coupling to the first rail vehicle.

Since the 'lock' function is typically controlled by a train management system somewhere in the train formation, for example in a locomotive, there is some risk of incorrect action when rail vehicles comprising couplers of the present invention are left isolated and not coupled to any train management system any longer. For example, suppose a freight train arrives in a siding and the locomotive uncouples from the front of the train formation. The locomotive's train management system unlocks the coupler on the front of the leading wagon first, otherwise the locomotive would be unable to uncouple. If the locomotive's train management system did not unlock the coupler at the rear of the formation before uncoupling, then a shunting engine would be unable to couple to the rear of the train to swap the wagons around. To address this, the control system 100 is arranged to reset the 'lock' function to the unlocked state in all vehicles when power supply (sourced from a locomotive or other vehicle with a train management computer) is removed, which in this embodiment is a 230V DC supply used to power the ECP braking system. In this way, the current coupling status of each coupler does not change, but the reset of the lock function ensures that isolated unpowered rail vehicles will always permit other rail vehicles (having couplers of the present invention) coming to retrieve them to be able to couple onto them.

Once the control system 100 has determined the appropriate state of the coupler via any command signals, i.e. to begin coupling or uncoupling, the processes already described are arranged to occur to achieve the desired result, i.e. to couple or uncouple the coupler 2 to or from another coupler respectively. As illustrated in FIG. 9, once each coupling process is confirmed to be successfully completed, an 'end' signal E passes to start S the next coupling process in sequence. The coupling/uncoupling process comprises the extension/retraction process, which extends or retracts the coupler 2 via the extension motor 24 accordingly, the connection/disconnection process, which connects or disconnects the mechanical coupling links 81 and 82 and the interface contacts 83, 84 in the coupler head 80 accordingly, and the contactor process, which connects or disconnects the high-power hotel bus lines to or from the conduction rods 40*a*, 40*b*, 40*c* accordingly.

For example, when the state of the 'coupling status request' latch 106 is set to the 'couple please' state, via the exchange of commands as described above, the extension motor 24 is actuated, causing rotation of the extending mechanism 6, which causes the extending tube 10, and thus the coupler head 80, to be extended from within the housing 90 (fast and then more slowly as the coupler head 80 contacts another coupler as described above). As the coupler head 80 is gradually extended and aligned with the other coupler head, the links within the Scharfenberg cup 81 and cone 82 are then brought into contact with the discs of their opposite couplers and rotate them as the coupler heads become closer together until the links engage in notches in the disc, the discs spring back and the coupler heads are mechanically coupled together, mechanically coupling the rail vehicles together. This event causes the extension motor 24 to be switched off and the extension process to stop. Subsequently, the male and female contacts 83, 84 are brought into contact with one another and coupled together, coupling the first set of connections between the rail vehicles together. Finally, the rod contacts 51*a*, 51 *b*, 51*c* are switched to connect the high-power hotel bus lines to the rods 40*a*, 40*b*, 40*c*, coupling the second set of connections between the rail vehicles together.

When the state of the 'coupling status request' latch 106 is set to the 'uncouple please' state, via the exchange of commands as described above, these processes occur in reverse order: the contact rods are switched to disconnect the hotel bus lines from the rods, the male and female contacts in the coupling interface 84 are disconnected, the uncoupling cylinder 116 is activated to rotate the Scharfenberg disc against its spring and disengage the link within the cone 82 from the disc of the other coupler, thus mechanically uncoupling the coupler heads from one another. The coupler 2 is then retracted (first slowly and then more quickly as the coupler head 80 no longer contacts the other coupler as described above) from the extended position to the retracted position within the housing 90.

In this embodiment, the control system 100 is arranged to check various signals from these processes, via a separate monitor logic unit 118, to confirm the coupling or decoupling processes are occurring as intended. Once the coupling (or decoupling) process is complete, the logic unit 118 generates a 'coupling complete' or 'uncoupling complete' accordingly, which is provided to the train management system of the rail vehicle. Should a fault occur during these processes, a 'fault' signal is generated instead such that the cause of the fault can be investigated. These fault signals can be checked by train management systems to confirm whether the intended actions have been carried out or not.

As noted earlier, a coupling event signal is arranged to be generated by the control system 100 and distributed throughout the train formation via dedicated contacts in the coupler head 80. This signal is arranged to be provided to the control systems of any sources of hotel power, such that the sources of hotel power can be switched off temporarily during coupling or uncoupling operations upon receipt of the coupling event signal. The coupling event signal is also arranged to be provided to all train management systems. In this case, upon receipt of the coupling event signal, the train management systems are arranged to determine their new formation of rail vehicles, and to calculate what operational constraints now apply to the new train formation. In some embodiments, the coupling event signal may also be provided to other systems which require updates about changes in the train formation, for example a seat reservation computer sending information automatically to displays in newly added carriages via the train information bus.

The coupling event signal is equivalent to the 'coupler switch' signal in the application GB2487224, which is incorporated herein by reference. In addition, this signal incorporates a transient pulse from the RD function, as well as indicating a coupling or uncoupling action in progress as previously described. This function allows train management systems to be interrupted, to detect the presence of the RD 'request declined' flag, and then to alert staff that the attempt to couple or uncouple was unsuccessful such that they can investigate. By interacting with the energy management function the pulse on the coupling event signal will also create a temporary interruption in hotel power sources—this rare eventuality may help to alert all staff that an error has occurred and investigations are needed.

The coupling event signal line, illustrated in the bottom left-hand side of FIG. 9, rests at a positive voltage level, via a pull-up resistor R from a positive voltage supply +V, and is pulled low/to earth (i.e. grounded) by a switch when the switch is active. Any control systems of couplers according to the present invention in a train formation are coupled to the same coupling event signal line in parallel. This arrangement ensures that if a pair of couplers operate at slightly different speeds, during the coupling or uncoupling process, the faster operating coupler grounds the 'coupling event' line first, and only when the slower coupler has finished does it release the coupling event signal line back to the positive voltage supply +V. As a result, the sources of hotel power can switch off quickly when the coupling event signal line is grounded, before the hotel bus contactor in the faster coupler has moved far enough to operate; the coupling event signal line being drawn high again indicates to train management systems that all coupling or uncoupling activities have ceased and investigations into the new train formation can begin.

The diode D in series with the pull-up resistor R ensures that if the supply voltages +V in different rail vehicles vary (as they might due to different levels of battery charge, for example) then the inactive coupling event signal line rises to the highest voltage connected in the train formation. No current flows in the coupling event signal line circuit in the inactive state, providing minimal power consumption for this arrangement.

FIGS. 10*a* to 10*h* illustrate an overview of the principles of the coupling process between a pair of rail vehicles, each comprising a coupler according to the present invention. As shown in FIG. 10*a*, a first rail vehicle 1*a* and a second rail vehicle 1*b* comprise a first coupler 2*a* and second coupler 2*b* respectively.

The couplers 2*a*, 2*b* are mounted to the underside of the rail vehicles 1*a*, 1*b* (i.e. on a side of the rail vehicle that faces the railway tracks), proximate the ends of the rail vehicles 1*a*, 1*b* (i.e. proximate an end of the rail vehicle that would face another nearby rail vehicle). This positional arrangement provides clearance to allow extension of the tube 10 when rail vehicles are close together, or the couplers are retracted out of use within the housing 90—it is easiest to arrange this underneath the main structure of the rail vehicle. The low position of the coupler is also able to facilitate lower rail vehicle floors, for example flat wagons carrying containers through tunnels with restricted heights, or carriages with uniformly lower floors and corridor connections giving step-free access from high platforms.

Further, this arrangement allows the end of the rail vehicle to be equipped with both a coupler according to the present invention and a conventional coupler above it, providing the option of either utilising the coupling system of the present invention or the conventional coupling system. This is useful, as a 'dual-equipped' rail vehicle, having both a coupler (according to the present invention) and a conventional coupler, is able to couple to other rail vehicles that do not have a coupler (according to the present invention), which will help to facilitate a transition of rail vehicles from utilising conventional methods to utilising methods of the present invention.

If such a dual-equipped rail vehicle is required to couple to another rail vehicle having only a conventional coupler, the coupler 2 is kept fully retracted out of use and does not come into contact with the other rail vehicle. On the other hand, if the dual-equipped rail vehicle is required to couple to another rail vehicle with a coupler according to the present invention, both couplers are able to extend sufficiently to ensure that the conventional coupler does not come into contact with the other rail vehicle.

The first rail vehicle 1*a* is static and is approached by the second rail vehicle 1*b*. The second vehicle 1*b* comes to a stop a short distance away in (as shown in FIG. 10*b*), and its brakes are fully applied.

As illustrated in FIG. 10*c*, a RTC signal is transmitted from the coupler 2*b*, asking for permission to couple to the coupler 2*a*. The RTC signal will typically be initiated by the arriving rail vehicle (rail vehicle 1*b* in FIG. 10*c*), but it may come from either rail vehicle 1*a* or 1 *b*.

The rail vehicle 1*a* receives the RTC signal and, if it agrees to be coupled with as described earlier, returns an ATC signal to the rail vehicle 1*b*, confirming that permission to couple has been granted, as illustrated in FIG. 11*d*.

Reception of the ATC signal successfully in the rail vehicle 1*b* initiates the coupling process of the coupler 2*b*, and the coupler 2*b* begins to extend from its retracted 'out of use' position (within the housing 90) and starts to extend outwardly. The reception of the RTC signal by the rail vehicle 1*a*, in combination with transmission of the ATC signal, also initiates the coupling process in that vehicle as well. Since the exchange of signals takes place quickly, in comparison with the physical movement of the couplers, in effect both couplers 2*a*, 2*b* start to extend simultaneously. The situation with both couplers partly extended a short time later is shown in FIG. 10*e*.

The couplers 2*a*, 2*b* extend until they contact one another, where the coupler heads (and their respective connections) couple together and the extension process is stopped automatically, illustrated in FIG. 10*f*. Since both couplers 2*a*, 2*b* start extending at the same time and extend at approximately the same speed, the junction between them will be about halfway between the two rail vehicle ends. Any variations in extension speed (e.g. due to friction effects or differing power levels) will result in an off-centre coupling junction, i.e. too little extension in one coupler is matched by more extension in the other.

Consequently, the coupler 2 allows for a substantial range of inter-vehicle spacing. When rail vehicles have stopped further apart than intended, the couplers 2*a*, 2*b* extend further to accommodate this extra distance, as illustrated in FIG. 10*g*. Conversely, if braking was left a little later than intended and the stopped rail vehicles 1*a*, 1*b* are closer together, the couplers 2*a* 2*b* extend a shorter distance, as illustrated in FIG. 10*h*. In this way, the coupler 2 is able to accommodate a wide variety of operating conditions of the rail vehicles 1*a*, 1*b*.

In other words, a distance between the retracted position and the extended position defines a variable coupling range of the coupler 2, and the coupler 2 is able to engage and couple to another coupler at any distance along its coupling range, provided the coupler 2 is extended to at least its minimum coupling distance, i.e. when the coupler 2 is extended from the retracted position to outside of the housing 1.

As described above, once the coupler heads are securely mounted to each other, various checks are performed automatically to confirm that all the systems are in their correct state, and train management systems are alerted that the train formation has changed such that they can determine what operation modes are now possible, and agree which of these management systems exercises control over the new train formation.

Once coupling is complete, the extension mechanisms of both couplers 2*a* 2*b* are locked in position, and the rail vehicles 1*a*, 1*b* remain the same distance apart as long as they are coupled together.

Uncoupling of rail vehicles also takes place with all rail vehicles stationary and their brakes are fully applied. The train management systems in the joined train formation agree (after various safety checks) where the split in the formation (via uncoupling of a pair of couplers according to the present invention) is to be made. An uncoupling command is then sent to the control system of one of the couplers on either side of the intended separation point in the train formation. Subject to the exchange of RTU and ATU signals between the couplers in question, as described above, the coupling heads (and their respective connections) uncouple and are withdrawn/retracted towards the retracted position until the couplers reach their retracted 'out of use' position at the vehicle ends.

Figure 10:
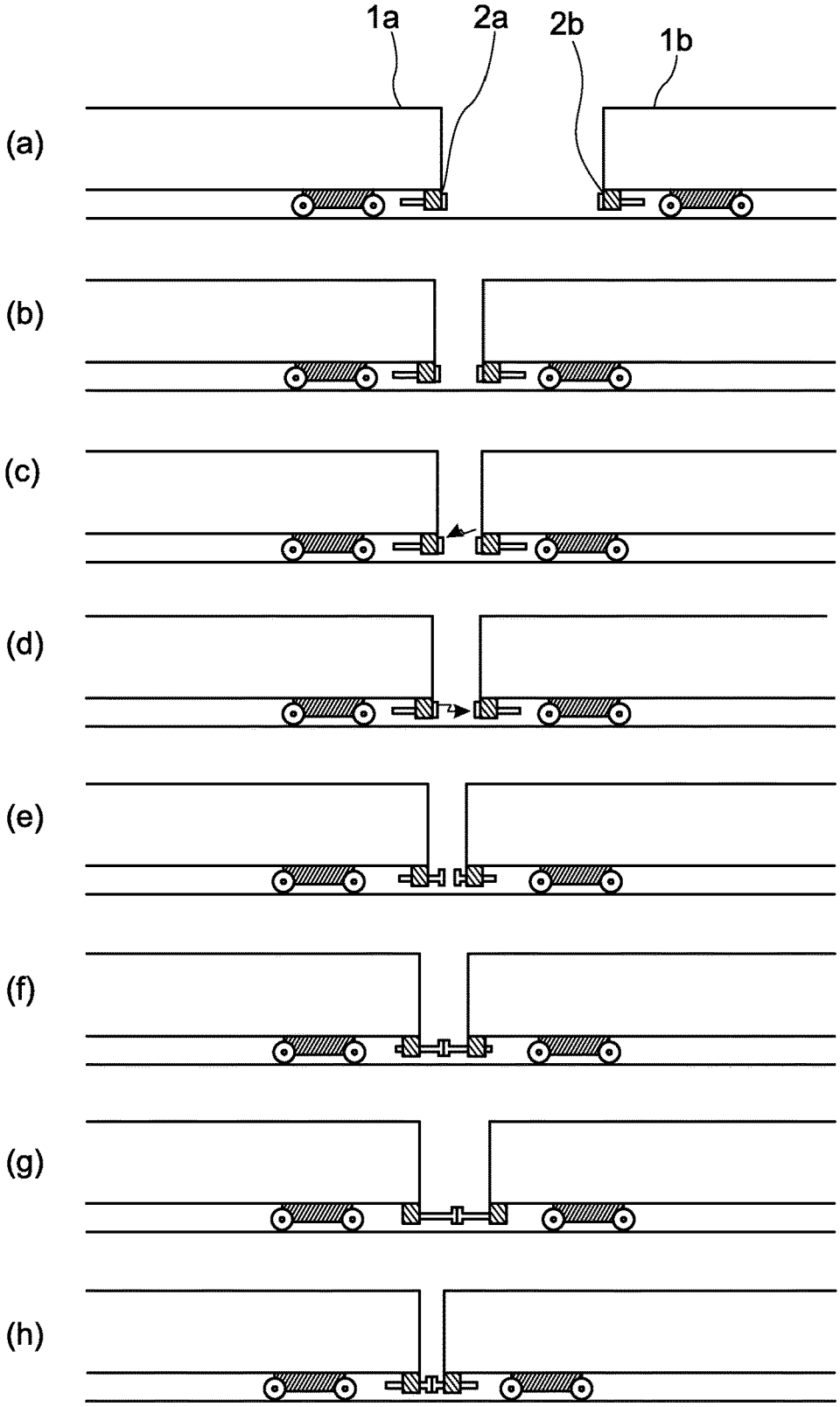
FIGS. 10*a*, 10*b*, 10*c*, 10*d*, 10*e*, 10*f*, 10*g* and 10*h* illustrate a perspective view showing the process of coupling a first and a second rail vehicle together using a pair of couplers according to the present invention, in particular

As described earlier, it is also possible for vehicles to be coupled or uncoupled when moving under some circumstances if desired, as well as when all vehicles are stopped and their brakes are fully applied as illustrated in FIG. 10. The coupler and its control system according to the present invention do not themselves impose any restrictions on the conditions under which coupling or uncoupling commands may be issued. The coupler and its control system simply act on instructions given to couple or uncouple, and when the necessary actions are competed the new coupling status is recorded. The definitions to constrain what actions are allowed under what conditions are the responsibility of train management computers and other control systems to decide. This allows new methods of working and alterations to operating rules to be accommodated as they evolve over time by changes to the software in the train management computers and/or other local or remote management systems, without any alterations to the coupler or control system of the present invention. The operating rules might vary according to the type of vehicle, for example hump shunting might be allowed for freight wagons but not for passenger carriages, and this difference is catered for by the train management computers or other arrangements knowing the rules and which kinds of vehicles they are dealing with.

Returning to FIG. 1, in this embodiment, the coupler 2 comprises a cover housing 3, which is arranged to occupy the dotted lines illustrated in FIG. 1. In this way, the coupler 2 is protected from the environment and live electrical components, discussed further below, are concealed. The cover housing 3 is large enough to accommodate all movements of the coupler 2. An off-centre retracting coupler 2 will be first encouraged to return to a balanced central position by the shields 85*a*, 85*b* contacting the housing 90, which helps force the coupler 2 into a central position, along with the wedging action described above, as the coupler reaches the 'out of use' retracted position. Consequently, angular displacements of the insulator 43*b* are curtailed as it heads towards the inner end of the extension mechanism 6 and the angular clearances required for the insulator 43*b* are reduced as its distance from the central pivot point increases. As a result, the cover housing 3 is only slightly wider at an inner end of the coupler 2 than it is at an outer end, proximate to the housing 90.

The area occupied by the coupler and its housing and cover under the main structure of a typical rail vehicle near its ends does not typically contain major components (wheels being further from the vehicle end). Therefore, the coupler 2 is sized suitable to occupy this area.

In some embodiments, the coupler 2 may be integrated with a rail vehicle such that it is able to be extended and retracted to carry out the coupling and decoupling process, and pivot accordingly due to movements between rail vehicles on a railway track.

In some embodiments, a lightweight expanding bellows-type cover with a rectangular cross section (not shown in FIG. 1) may be used between the rear of the coupler head 80 and the gimbal frame 30 to protect the extendable tube 10 and conduction rods 40*a*, 40*b*, 40*c*, whatever the degree of extension in use.

In some embodiments, a damper, or dampers, (not shown in FIG. 1) may be fitted between the housing 90 and gimbal frame 30 to discourage lateral oscillations between coupled rail vehicles for better stability.

In summary, the coupler 2 is intended for main line railways carrying a variety of traffic over significant distances and using a variety of different types of rolling stock. Smaller railway networks restricted to one type of train (such as urban metros) will usually opt for their own particular, simpler, coupling arrangement as interoperability is not required.

The coupler 2 is intended to be a universal mechanism to allow the coupling and uncoupling between of all kinds of rail vehicles using a variety of different train architectures. These include the traditional locomotive hauling unpowered carriages or wagons; multiple unit trains with groups of vehicles combining traction capability and passenger or freight accommodation; power-car-and-trailer style trains with a combination of powered and unpowered vehicles; long freight trains with several locomotives dispersed in various ways along the train formation; a passenger train hauled by a locomotive which does not provide electricity for the train lighting, heating and air conditioning, but such power is obtained instead from a generator car somewhere else in the train formation; a driving cab in a powered or unpowered vehicle; a powered vehicle with or without a driving cab; vehicles having regenerative or rheostatic braking to supplement the usual friction brakes; and vehicles having significant energy storage facilities suitable for supplementing traction or electrical power.

Some types of train (notably diesel or electric passenger-carrying multiple units) have their key functions distributed around a group of vehicles. In this case, the vehicles cannot be operated separately but need to work together as a group in a fixed formation to operate correctly. Normally, such vehicles are coupled together semi-permanently using bar couplers, and they are only separated in depots for maintenance and replacement purposes. Within the group there might be provision for the distribution of power for traction between vehicles, for example from a transformer in one car to traction motors in another car. Since a great variety of different requirements specific to a particular train design might be present, couplings and interfaces between such vehicles need to be specially designed for that application. However, the coupler 2 of the present invention is able to couple to the outer ends of the group, in effect treating the multiple unit as a single vehicle for the purposes of train formations. This then allows both the usual coupling together of several multiple unit trains, but also allows the attachment of simpler unpowered carriages to one or more multiple unit groups when additional capacity is necessary via couplers of the present invention.

The extending and retracting mechanism of the coupler 2, along with the coupling arrangements of the coupler head 80 and coupling interface 84, result in a coupler (as per the present invention) that does not need to be physically shunted to another coupler in order for the couplers to be coupled together. In this way, the coupler 2 is not subject to all of the disadvantages associated with the shunting process of conventional couplers, as outlined previously. Instead, rail vehicles having couplers according to the present invention only need to be stopped reasonably close together, within a certain tolerance and without touching, for coupling to be achieved over varying distances and operating conditions.

The coupling process according to the present invention has many advantages compared with conventional methods. Rail vehicles come to a stop without touching each other, avoiding any jolting that would occur from collisions between the two rail vehicles. Further, the extension/retraction process is controlled with defined speeds and forces. When the coupling heads join together, the extension process is stopped automatically, and the action is not dependent on the skill of staff or the dynamics of the train to operate correctly. As a result, the coupling action gives minimal disturbance to the already halted vehicles, and no risk of damage to items or injury to people.

The unique ability of a train to drastically alter its capacity, and to rearrange parts of its formation into other trains if required, is an enormous potential asset not available to road, air or maritime transport competitors. In many cases that key advantage cannot be exploited effectively at present due to limitations of the current coupling systems.

Since when using the coupler of the present invention all rail vehicles can be stationary and the brakes fully applied, the coupling and uncoupling process is independent of rail vehicle movement, and no further shunting is needed once rail vehicles are within the coupling range of the coupler 2. A shunting locomotive assembling wagons for a train in a freight yard need not wait for actual coupling to take place: once a wagon is in position the locomotive can uncouple from it and go to retrieve the next wagon immediately. When all the rail vehicles intended for the train are in position, the coupling process can be initiated, either by the shunting locomotive, by the train's locomotive when it arrives, or indeed by any other rail vehicle equipped with a train management system.

Loading and unloading of passengers or freight can also take place as soon as the rail vehicles have come to a stop; there is no need to wait for any coupling or uncoupling actions to be completed. Instead, both coupling or uncoupling and loading or unloading can be done in parallel, saving time overall compared to the current methods.

This separation of coupling/uncoupling actions from rail vehicle movement also facilitates last-minute decision making about what a train's formation should be. Rail vehicles can be lined up in anticipation of particular traffic requirements to be coupled to the train formation, but if less traffic materialises or some would be better handled by a different train it is easy to leave some rail vehicles behind without disrupting the loading and unloading process.

The coupler 2 of the present invention offers significant opportunities for time saving, cost saving, energy saving and better reliability of rail services by removing many of the difficulties of conventional automatic couplers. Changing train formations becomes easier, allowing more attractive services to improve railways' competitive position in relation to other methods of transport. Further, the coupler 2 facilitates future innovative ideas for automation of train operations.

The invention claimed is:

1. A coupler (2) for coupling rail vehicles together comprising:

an extendable coupling body (10);

an extending mechanism (6);

a controller (100) arranged to control actuation of the extending mechanism (6); and a support housing (20) for mounting the coupler (2) to a railway carriage, wherein the coupling body (10) and the extending mechanism (6) are mounted within the support housing (20);

wherein the extending mechanism (6) is arranged to be actuated to move the coupling body (10) relative to the support housing any distance between a retracted position and an extended position such that a coupling interface (84) of the coupler (2) and a coupling interface of a second coupler can couple together independent of rail vehicle movement, a distance between the retracted position and the extended position defining a coupling range of the coupler (2);

wherein the coupling interface (84) is arranged to receive connections of the railway carriage for coupling to a coupling interface of a second coupler;

wherein a distance between the coupling interface (84) and the support housing (20) increases as the coupling body (10) moves from the retracted position towards the extended position; and wherein the coupling interface (84) is arranged to engage the coupling interface of the second coupler upon contact between the interfaces such that the coupling interface (84) can engage the coupling interface of the second coupler at any distance within the coupling range without requiring any rail vehicle movement.

2. The coupler as claimed in claim 1, wherein the extending mechanism is substantially cylindrical and mounted to the support housing via a bearing arrangement (16*a*, 16*b*) such that the extending mechanism is constrained axially but may rotate freely relative to the support housing.

3. The coupler as claimed in claim 2, wherein the coupling body comprises a first end (11) having the coupling interface, and an opposing second end; and wherein at least a portion of the coupling body between the first and second end is substantially cylindrical, the extending mechanism substantially encircling, and being in threaded engagement with, the cylindrical portion, and the coupling body being constrained rotationally, the coupler further comprising a drive means (24) that is arranged to rotate the extending mechanism when the drive means is actuated by the controller; and wherein the drive means comprises a locking mechanism that is arranged to prevent rotation of the extending mechanism when the drive means is not being actuated.

4. The coupler as claimed in claim 3, wherein the coupling interface comprises:

an inner termination portion (45*a*) which substantially faces the second end and is arranged to receive the connections of the railway carriage; and an opposing outer coupling head (80), wherein the coupling head comprises:

an engaging means (81, 82) that is arranged to reversibly engage a coupling head of the second coupler upon contact between the coupling heads; and coupling contacts that are arranged to couple to the connections of the railway carriage from the termination portion, and reversibly couple to coupling contacts of the second coupler upon engagement between the coupling heads.

5. The coupler as claimed in claim 4, wherein the support housing is mounted to the railway carriage via a gimbal frame, the support housing being rotatably mounted to the gimbal frame (30) via a bearing arrangement (31*a*, 31*b*);

wherein the gimbal frame is rotatably mounted to the railway carriage via a bearing arrangement; and wherein the gimbal frame is mounted to the railway carriage via a coupler housing (90), and the coupler housing substantially surrounds the coupling body such that the coupling head is within the coupler housing when in the coupling body is in the retracted position.

6. The coupler as claimed in claim 5, wherein the coupling head further comprises a covering arrangement (85*a*, 85*b*) that is arranged to:

cover the coupling head when the coupling body is in the retracted position to protect and/or seal the coupling head; and expose the coupling head when the coupling body is in the extended position;

wherein the covering arrangement comprises a first (85*a*) and a second (85*b*) elongate cover that are pivotally mounted to the coupling head such that the covers are moveable between an open and a closed position;

wherein in the open position, outer edges (95*a*, 95*b*) of the first and the second cover are substantially flush with the coupling contacts of the coupling head such that the coupling contacts are exposed, and in the closed position, the outer edges of the first and the second cover are in contact with one another such that the coupling contacts are between the first and second cover and the coupling head;

wherein the first and the second cover are held in a neutral position between the open and closed positions, and the coupler housing comprises housing projections (91*a*, 91*b*) that are arranged to engage the covers as the coupling body moves into the retracted position such that the covers are biased towards one another and move into the closed position; and wherein the first and the second cover are arranged to move from the neutral position into the open position upon contact with a first and a second cover of the second coupler.

7. The coupler as claimed in claim 6, wherein the first and the second cover comprise a longitudinal projection (88*a*, 88*b*, 88*c*) that is arranged to form a flange against the coupler housing when the coupling body is in the retracted position; and wherein the first and the second cover comprise sensors (98*a*, 98*b*) that are arranged to detect movement of the covers from the neutral position to indicate the proximity of the second coupler.

8. The coupler as claimed in claim 5, wherein the connections of the railway carriage comprise a first set of connections and a second set of connections; and wherein the second end comprises an opening into the coupling body, and the termination portion is arranged to receive the first set of connections via the opening.

9. The coupler as claimed in claim 8, wherein the support housing comprises longitudinal beams (33*a*, 33*b*) that receive, and are substantially parallel with, the coupling body; and wherein the coupling body has longitudinal grooves (14) that face the beams, and the beams have longitudinal protrusions that are arranged to engage the grooves to permit axial but restrict rotational movement of the coupling body.

10. The coupler as claimed in claim 9, wherein the beams are mounted together at an end distal from the support housing via a plate (43*a*), and the opening is arranged to receive the first set of connections via the plate.

11. The coupler as claimed in claim 10, wherein the first set of connections coupled between the termination portion and the plate are arranged in a spiral formation to allow extension and retraction of the first set of connections.

12. The coupler as claimed in claim 8, wherein the termination portion and the second end protrude radially relative to a longitudinal line of the coupling body, and the protruding portion of the termination portion is arranged to receive the second set of connections via the protruding portion of the second end.

13. The coupler as claimed in claim 12, wherein the first set of connections comprise at least one or more of low-power electrical connections, pneumatic connections and optical connections; and wherein the second set of connections are high-power electrical connections.

14. The coupler as claimed in claim 12, wherein the second set of connections comprise conductive rods (40*a*, 40, 40*c*) that are mounted between the protruding portions of the termination portion and the second end, and coupled at the second end to a hotel bus of the railway carriage.

15. The coupler as claimed in claim 14, wherein the rods are coupled to the hotel bus via rod contacts (51*a*, 51*b*, 51*c*) that are arranged to be switched between engaging and disengaging the rods.

16. The coupler as claimed in claim 15, wherein the rod contacts are mounted to the support housing via an insulated frame (50); and wherein the insulated frame comprises brushes (66) that contact the rods such that movement of the rods relative to the brushes removes oxidation from the rods.

17. The coupler as claimed in claim 1, wherein the controller is further arranged to operate the coupling, and communicate with a controller of the second coupler, wherein the controllers are arranged to synchronise the coupling and decoupling of the coupling interface with a coupling interface of the second coupler.

18. A method of controlling a first coupler as claimed in claim 1, the method comprising the steps of:

receiving a request to couple command from a second coupler (2*b*);

transmitting an agreement to couple command to the second coupler;

extending the coupling body from the retracted position towards the extended position;

causing the coupling interface to engage the coupling interface of the second coupler upon contact between the interfaces; and connecting at least a portion of the connections of the railway carriage to the coupling interface of the second coupler.

19. The method as claimed in claim 18, wherein a speed of the extension of the coupling body is reduced upon contact between the coupling interface and the coupling interface of the second coupler; and wherein a speed of the retraction of the coupling body is increased as the coupling interface no longer contacts the coupling interface of the second coupler.

20. The method as claimed in claim 19, wherein extension of the coupling body is stopped upon engagement between the coupling interface and the coupling interface of the second coupler; and wherein retraction of the coupling body begins upon disengagement between the coupling interface and the coupling interface of the second coupler.

* * * * *